United States Patent [19]

Hunt et al.

[11] Patent Number: 4,767,551

[45] **Date of Patent: * Aug. 30, 1988**

[54] METAL-CONTAINING LUBRICANT COMPOSITIONS

[75] Inventors: Mack W. Hunt; Steven Kennedy, both of Naperville, Ill.

[73] Assignee: Amoco Corporation, Chicago, Ill.

[ * ] Notice: The portion of the term of this patent subsequent to May 12, 2004 has been disclaimed.

[21] Appl. No.: 929,628

[22] Filed: Nov. 10, 1986

Related U.S. Application Data

[63] Continuation-in-part of Ser. No. 803,589, Dec. 2, 1985, Pat. No. 4,664,822.

[51] Int. Cl.[4] ..... C10M 137/10; C10M 139/00

[52] U.S. Cl. ..... 252/32.7 E; 252/23.4; 252/37; 252/50; 252/51.5 A; 252/51.5 R; 252/56 R

[58] Field of Search ..... 252/32.7 E, 33.4, 37, 252/51.5 A, 50, 51.5 R, 56 R

[56] References Cited

U.S. PATENT DOCUMENTS

| | | | |
|---|---|---|---|
| 2,552,570 | 5/1951 | McNab et al. | 252/32.7 E |
| 3,346,493 | 10/1967 | LeSuer | 252/32.5 |
| 4,100,082 | 7/1978 | Clason et al. | 252/33.4 |
| 4,358,385 | 11/1982 | Zoleski et al. | 252/33.4 |
| 4,470,916 | 9/1984 | LeCoent et al. | 252/33.4 |
| 4,487,704 | 12/1984 | Yamaguchi et al. | 252/33.4 |
| 4,664,822 | 5/1987 | Hunt et al. | 252/49.6 |

*Primary Examiner*—Jacqueline V. Howard

*Attorney, Agent, or Firm*—Matthew R. Hooper; William H. Magidson; Ralph C. Medhurst

[57] ABSTRACT

A metal-containing lubricant composition containing an overbased copper metal-containing compound is disclosed which improves high speed, high temperature operation of gasoline and diesel engines. The overbased copper metal-containing compound acts as a dispersant/detergent and oxidation and corrosion inhibitor and avoids the acceleration of wear rates typical of many copper compounds.

16 Claims, No Drawings

METAL-CONTAINING LUBRICANT COMPOSITIONS

CROSS-REFERENCE TO RELATED APPLICATION

This is a continuation-in-part of application Ser. No. 803,589, filed Dec. 2, 1985, now U.S. Pat. No. 4,664,822.

FIELD OF THE INVENTION

This invention relates to overbased copper-containing lubricant compositions with improved stability and antiwear and antirust properties wherein the overbased copper-containing composition inhibits the oxidation of the lubricant and preserves the antirust properties of the lubricant without significantly decreasing the antiwear properties of the zinc dialkyldithiophosphate antiwear additive during use of the lubricant in an operating engine. The compositions of this invention are useful as lubricants in present-day automobile and diesel engines designed for high power output, lower combustion products emission, and longer in-service periods of use of crankcase lubricating oils. These compositions increase the useful life of a lubricating oil and thereby decrease the consumption of our limited oil resources.

Combustion and/or oxidation products from the burning and/or oxidation of fuel, lubricating oil and nitrogen of air as well as products of thermal and oxidation degradation of hydrocarbon lubricating oils and addition agents tend to concentrate in the crankcase oil. These products of combustion, oxidation, and thermal degradation tend to form oil-insoluble products that either surface coat metal parts with lacquer or varnish-like films or settle out as viscous sludge deposits or form ash-like solids or carbonaceous deposits. Any of these deposits can restrict and even plug grooves, channels, and holes provided for lubricant flow to moving surfaces requiring lubrication. Crankcase oils are formulated to not only reduce thermal and oxidative decomposition of the lubricating oil solvent and the added agents, but also to keep in suspension as a dispersant or to resuspend as a detergent insoluble combustion, oxidation and thermal degradation products, as well as to neutralize acidic products. Neutral and overbased metallo-organic compounds such as the alkaline earth metal salts of sulfonic acids and hydrocarbon $P_2S_5$ reaction products are used as dispersant-detergent addition agents and rust inhibitors. Their in-service drawbacks are that their combustion, oxidation, and/or thermal degradation products left metal ash solids and lost their dispersant/detergent function when their alkaline earth metal component had been consumed by neutralizing acidic products of combustion, oxidation, and thermal degradation.

Although metallo-organic compounds such as the alkaline earth metal salts of sulfonic acids act as dispersant-detergent addition agents and rust inhibitors in a lubricant composition, these compounds have the property of accelerating the oxidation process so as to increase the oxidative degradation of the lubricating oil components with consequent increased viscosity of the lubricant composition which tends to restrict or retard the lubricating function by restricting lubricant flow by the formation of sludge and like deterioration products. Corrosive acids also formed can harm the metal surfaces. Additive interaction between alkaline earth metal salts of sulfonic acids and anti-wear additives such as zinc dialkyldithiophosphates are known to reduce the effectiveness of antiwear additives. The lubricating art consequently is continually seeking agents which act as antioxidants and antirust agents. It is well-known that certain amines, hindered phenols, sulfurized olefins, oil soluble transition metal compounds having atomic numbers from 24 to 30, and molybdenum compounds are useful as antioxidants but antirust components which do not significantly affect antiwear components have not been known.

The invention accordingly relates to new chemical compositions and to mineral oil compositions with improved stability containing the chemical compositions. More particularly, it relates to overbased copper-containing compositions which act as dispersants, detergents, and oxidation, rust and corrosion inhibitors. Even more particularly, it relates to a novel class of overbased copper-containing compositions which act as dispersants, detergents, rust and oxidation inhibitors as an additive in a lubricating oil composition. A lubricant oil composition containing our novel additive does not have the undesirable increase in viscosity. A lubricant oil composition containing our novel additive does not have an undesirable decrease in antiwear properties of the zinc dialkyldithiophosphate antiwear additive often caused by the presence of a copper-containing antioxidant compound. These property advantages are critical and correlate well with reduced engine wear and passing high speed and high temperature engine tests. Lubricants containing additives which cannot pass high speed and high temperature engine tests with reduced engine wear do not have commercial utility in present-day automobile and diesel engines.

It is accordingly an object of this invention to provide lubricating oil compositions containing a lubricating oil, a dispersant, a viscosity index improver dispersant, an antiwear agent and a dispersant/detergent, antioxidant and rust inhibitor comprising an overbased copper-containing composition which provides an improved lubricating oil formulation for high speed, high temperature gasoline and diesel engine operation.

It is also an object of this invention to provide a dispersant/detergent antioxidant and rust inhibitor comprising an overbased copper-containing composition.

It is also an object of this invention to provide an overbased copper alkali or alkaline earth metal sulfonate rust inhibitor and antioxidant which does not significantly decrease the antiwear properties of zinc dialkyldithiophosphate.

It is a further object of this invention to provide a process for preparing these overbased copper-containing compositions.

These and other objects of this invention are achieved by providing a process and a Group I or Group II metal-containing compound comprising a reaction product of copper chloride or sulfate or carboxylate of from one to six carbon atoms and alkali or alkaline earth sulfonates or phenates or salicylates.

DISCUSSION OF THE PRIOR ART

It is well-known that copper compounds stabilize petroleum lubricating oils and inhibit the formation of sludge and like deterioration products. U.S. Pat. No. 2,343,756 teaches that the use of oil-soluble copper compounds in lubricating oils of from 50 to 500 parts per million (ppm) acts to stabilize the lubricating oil against deterioration so that engines can be operated with such lubricants without causing objectionable increase in the viscosity of the oils, objectionable corrosion of sensitive bearing metals and the formation of objectionable deposits in the engine parts. U.S. Pat. No. 2,343,756 teaches that the amounts of copper employed are critical. If the amount of oil-soluble copper is materially above 500 ppm, corrosion of bearing metals can be accelerated rather than inhibited.

U.S. Pat. No. 3,093,585 discloses a copper antioxidant composition for lubricating oils comprising an ester-type base fluid and oxidation stabilizing amounts of both an amine and complexes of such amines with copper salts of fatty acids. The fatty acids include acetic, propionic, caproic, stearic, oleic, etc.

Other patents disclose the use of copper antioxidants, i.e., U.S. Pat. Nos. 3,322,802; 3,412,118; 3,634,238; 4,110,234; 4,122,033; Canadian Pat. No. 1,170,247 and equivalent European Pat. No. 24146.

It is also well-known that additive components in a lubricating oil formulation often react with each other with deleterious effects. It is known that copper compounds present in the form of an antioxidant interfere with the antiwear properties of zinc dialkyldithiophosphates, as is taught in Canadian Pat. No. 1,170,247 and European Pat. No. 24146.

In particular, European patent No. 24146 discloses the use of such copper compounds in lubricating oil compositions that may also contain magnesium and calcium-containing additives.

Although magnesium and calcium-containing additives are frequently included in lubricating compositions, as is taught in European Pat. No. 24146, it is also well-known that certain alkaline earth metal salts of sulfonates, specifically barium and calcium sulfonates, interfere with the antiwear properties of zinc dialkyldithiophosphates. Reference is made to *ASLE Trans.*, No. 2., Vol. 21, pp. 91-101, (1978) and U.S. Pat. No. 4,487,704.

It has been found, also, that lubricating oil compositions containing overbased magnesium hydrocarbyl sulfonates tend to offset the effectiveness of the zinc salts of dihydrocarbyl dithiophosphoric acids to provide sufficient wear protection in the internal combustion engine of an automobile.

As noted above in the prior art, copper-containing additives are well known to be useful as antioxidant additives in lubricating oil compositions. However, the prior art neither teaches nor suggests our novel composition or process which includes the discovery that the addition of overbased copper-containing compositions improve high speed, high temperature operation of gasoline and diesel engines.

SUMMARY OF THE INVENTION

A metal-containing lubricant composition containing an overbased copper-containing compound is disclosed which improves high speed, high temperature operation of gasoline and diesel engines. The overbased copper-containing compound acts as a dispersant/detergent and oxidation, rust and corrosion inhibitor, and avoids the acceleration of wear rates typical of many other copper compounds.

DETAILS OF THE INVENTION

The present invention provides a lubricating oil composition which comprises: (a) a major amount of a lubricating oil; (b) from 0 to 10 (wt) % of an ashless dispersant; (c) from 0 to 10 (wt) % of at least one viscosity index improver selected from the group consisting of a nitrogen-containing polymeric viscosity index improver dispersant, an ester-containing polymeric viscosity index improver dispersant, and a non-dispersant viscosity index improver, and (d) from 0.01 to 10.0 parts by weight per 100 parts of said lubricating oil composition of zinc dialkyldithiophosphate and characterized in that the lubricant oil composition contains from 0.1 to 5.0 (wt) % of a dispersant/detergent, antioxidant, and rust inhibitor comprising an overbased copper metal-containing compound selected from the group consisting of an overbased copper sulfonate, an overbased copper phenate, and an overbased copper salicylate wherein the said compounds contain magnesium, calcium, or sodium.

The lubricating composition can contain additional conventional additives such as supplementary dispersants of the ash-containing type, antioxidants, friction modifiers, ashless rust inhibitors, pour point depressants, antifoam agents, extreme pressure agents, viscosity index improvers, and supplemental oxidation and corrosion inhibiting agents such as ashless rust inhibitors.

The lubricating oil in which the compositions of this invention are useful as additives can be of synthetic, animal, vegetable, or mineral origin. Ordinarily, mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally the lubricating oils preferred will be fluid oils, ranging in viscosity from about 40 Saybolt Universal seconds at 100° F. to about 200 Saybolt Universal seconds at 210° F.

The invention further comprises a process for preparing an overbased copper-containing composition which comprises: (a) mixing at ambient temperature to about reflux temperature of said mixture a mixture of (1) from about 0.1 to about 15 parts by weight of an oil-insoluble neutral acid copper salt, (2) from 25 to 200 parts by weight of an overbased metal-containing compound selected from the group consisting of alkali metal and alkaline earth metal sulfonates, phenates and salicylates, (3) from 25 to 200 parts by weight of an alcohol of from 1 to 10 carbon atoms, and (4) from 25 to 200 parts by weight of a hydrocarbon solvent of from 6 to 18 carbon atoms; (b) mixing and heating said mixture at a temperature of from about 25° C. to about reflux temperature of said mixture for a period of up to 4 hours; (c) removing said alcohol and said solvent from said mixture by distillation at a temperature of up to said reflux temperature under conditions of ambient pressure or of vacuum; (d) clarifying the bottom product by filtration or by centrifugation.

The instant invention comprises a process wherein said oil-insoluble neutral copper salt is selected from the group consisting of copper carboxylates of from 1 to 6 carbon atoms, copper chloride and copper sulfate, and an alkali metal and alkaline earth metal is selected from the group of barium, calcium, magnesium and sodium.

The overbased metal-containing compound can be magnesium sulfonate, barium sulfonate, calcium sulfonate or sodium sulfonate. The overbased metal-containing compound can be selected from the group consisting of barium, magnesium, calcium or sodium sulfonates, phenates or salicylates.

The invention further comprises a process for preparing an overbased magnesium sulfonate which comprises: (a) addition to a suitable vessel of a charge mixture of (1) about 30 to about 90 parts by weight of ammonium sulfonate, (2) about 50 to about 120 parts by weight of No. 100 neutral petroleum oil, (3) about 100 to about 400 parts by weight of xylene, and (4) about 25 to about 60 parts of magnesium oxide wherein said magnesium oxide was added during mixing at ambient temperature to about reflux temperature of said charge mixture; (b) heating said charge mixture to about 100° F. wherein from about 10 to about 35 parts by weight of methanol is added and heating is continued up to about 140° F. wherein from about 30 to about 60 parts by weight of water is added and the resulting mixture is refluxed for up to 4 hours; (c) distilling said mixture to remove methanol, water and xylene at a temperature of up to about 225° F. at ambient pressure; (d) cooling said mixture to about 100° F. and thereupon carbonating said mixture with about 35 to about 90 parts by weight of carbon dioxide at a temperature of from about 60° F. to about 200° F. until said mixture is saturated; (e) removing magnesium oxide impurities by centrifuge or filtration; and (f) removing remaining xylene, methanol and water by distillation at a reflux temperature.

The ashless dispersant useful in the lubricating oil composition can be selected from the group consisting of Mannich base dispersants, succinimides, succinate esters, succinate ester amides and mixtures of two or more of the above dispersants. These groups are further discussed in detail oelow under paragraphs labeled 1–5, inclusive.

1. Mannich base dispersants made from the reaction of alkylphenols, formaldehyde, and amines. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated by reference.

Representative high molecular weight aliphatic acid modified Mannich condensation products useful in this invention can be prepared from high molecular weight alkyl-substituted hydroxyaromatics or HN< group-containing reactants.

Representative of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600–100,000 molecular weight.

The 600 and higher molecular weight alkyl substituents on the hydroxyaromatic compounds can be derived from high molecular weight polypropylenes, polybutenes, and other polymers of mono-olefins, principally 1-monoolefins. Also useful are copolymers of mono-olefins with monomers copolymerizable therewith wherein the copolymer molecule contains at least 90% by weight of mono-olefin units. Specific examples are copolymers of butenes (butene-1, butene-2, and isobutylene) with monomers copolymerizable therewith wherein the copolymer molecule contains at least 90%, by weight, of propylene and butene units, respectively. Said monomers copolymerizable with propylene or said butenes include monomers containing a small proportion of unreactive polar groups such as chloro, bromo, keto, ethereal, and aldehyde, which do appreciably lower the oil-solubility of the polymer. The comonomers polymerized with propylene or said butenes can be aliphatic and can also contain nonaliphatic groups, e.g., styrene, methylstyrene, p-dimethylstyrene, divinyl benzene, and the like. From the foregoing limitation placed on the monomer copolymerized with propylene or said butenes, it is abundantly clear that said polymers and copolymers of propylene and said butenes are substantially aliphatic hydrocarbon polymers. Thus the resulting alkylated phenols contain substantially alkyl hydrocarbon substituents having molecular weights upward from 600.

In addition to these high molecular weight hydroxyaromatic compounds, others which can be used include those which have been used to prepare prior low molecular weight Mannich condensation products, e.g., high molecular weight alkyl-substituted derivatives of resorcinol, hydroquinone, cresol, catechol, xylenol, hydroxy diphenyl, benzylphenol, phenethylphenol, naphthol, and tolylnaphthol, among others. Preferred for the preparation of the before mentioned preferred bis Mannich condensation products are the polyalkylphenol reactants, e.g., polypropylphenol and polybutylphenol whose alkyl groups have an average number molecular weight of 600–3,000, the most preferred being polybutylphenol whose alkyl group has an average number molecular weight of 850–2,500.

Representative of HN< group-containing reactants are alkylene polyamines, principally polyethylene polyamines. Other representative organic compounds containing at least one HN< group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Suitable alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(A—NH—)_nH$, mentioned before, A is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (b-hydroxybutyraldehyde). Formaldehyde or a formaldehyde-yielding reactant is preferred.

The aliphatic acid reactant of the Mannich dispersant can have a carbon atom content of a total (including the carbon of the carboxylic acid group) of from about 6 to about 100 and comprises the alkanoic (saturated) and alkenoic (mono-unsaturated) acids. The upper limit of the carbon content is restricted only by the largest carbon atom content of such acids available or capable of feasible preparation. Such aliphatic acids can be natural and synthetic mono-, di-, and tri-carboxylic acids. Suitable natural aliphatic acids are the natural fatty acids obtainable by known hydrolysis (acid and alkaline) of vegetable and animal oils and fats and wax esters. The preferred natural acids have from 10 to about 20 total carbon atoms per carboxylic acid group. Suitable synthetic acids can be derived from oxidation of the alcohol moiety of the wax ester where such alcohol moiety has at least 6 carbon atoms; from the polymerization of unsaturated natural acids having about 2 or 3 carbon to carbon double bonds (dimer and trimer acids) and the hydrogenation of residual carbon to carbon double bonds in such polymer acids. For example, the polymer acids obtained from oleic acid, euric acid, linoleic acid, and linolenic acid and other unsaturated acids; and from oxidation or other reactions of polypropenes and polybutenes (e.g., polyisobutenes) which introduce one or more carboxylic acid groups on the polymer chain.

Suitable alkanoic acids having about 6 or more total carbon atoms are those obtainable from the glycerides; vegetable oils and animal fats, and the wax esters by the known hydrolysis or saponification-acidification or acid treatment processing of said oil and fat glycerides and the wax esters (i.e., natural waxes), the oxidation of the mono-alcohol obtainable from the simple ester of the wax esters and known acid synthesis. Such suitable alkanoic acids, i.e., those having R groups of about 6 to about 30 carbon atoms, include caproic acid, caprylic acid, capric acid, hendecyclic acid, lauric acid, tridecylic acid, myristic acid, pentadecylic acid, palmitic acid, margaric acid, stearic acid, nonadecylic acid, arachidic acid, medullic acid, behenic acid, lignoceric acid, pentacosoic acid, cerotic acid, heptacosoic acid, monocosoic acid, montanic acid, and melissic acid. Many of said alkanoic acids are obtained first in mixtures of two, three, or more alkanoic acids of different carbon contents from said glycerides and wax esters, said mixtures can be used in this invention in place of a single alkanoic acid reactant. When said mixtures of alkanoic acids also contain unsaturated acids it is preferred that such mixture of acids be reduced to a product which is substantially free of unsaturation.

Suitable alkanoic acids having a total of at least 6 carbon atoms include those from hexenoic, heptenoic, octenoic, etc. acids up to oleic ($C_{18}$) and erucic ($C_{22}$) acids. Also suitable are the dimer acid of linoleic and its saturated dimer analog; dimer and trimer acids of linolenic acid and the saturated dimer and trimer analogs. Other polymeric acids, e.g., codimers of oleic and linoleic or linolenic acids and the saturated analogs of those dimer acids, are also suitable.

An example of a Mannich condensation product can be the reaction product in the ratios of about 1 mole of polyisobutenylphenol with from about 1 to 10 moles of formaldehyde and from about 0.5 to about 2 moles of polyethylenepolyamine and from about 0.1 to about 1 moles of a $C_6$ to $C_{100}$ alkanoic or sulfonic acid. The Mannich condensation product can be borated in the ratio of from about 0.1 to about 5 moles boron per mole of polyisobutenylphenol.

The foregoing, while not an exhaustive listing of all suitable aliphatic acid reactants of the class before defined, will provide adequate guidance for the chemist skilled in this art and also bring to mind other suitable aliphatic acids within the scope before defined.

2. Succinimides—Condensation reaction products between alkenyl succinic anhydrides and amines. Molar ratios can vary depending on the polyamine, e.g., the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, which are incorporated herein by reference.

3. Succinate Esters—Condensation reaction products berween alkenyl succinic anhydrides and alcohols or polyols. Molar ratios can vary depending on the alcohol or polyol used. An example of this product is the condensation between an alkenyl succinic anhydride and pentaerythritol.

4. Succinate Ester Amides—Condensation reaction products between alkenyl succinic anhydrides and alkanol amines such as ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305 which patent is incorporated herein by reference.

The molecular weight of the alkenyl succinic anhydrides in subparagraphs 2, 3, and 4 typically will range between 800 and 2,500. All of the above dispersant reaction products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

5. Mixtures of two or more of the above dispersants.

The succinimide, succinate esters, or succinate ester amides useful in this invention can be prepared by the reaction of a hydrocarbon-substituted succinic acid compound having at least 50 carbon atoms in the hydrocarbon substituent, with at least one equivalent of an alkylene amine.

The hydrocarbon substituent can contain polar groups provided, however, that the polar groups are not present in proportions sufficiently large to alter significantly the hydrocarbon character of the substituent. The polar groups are exemplified by chloro, bromo, keto, ethereal, aldehydo, and nitro, etc. The upper limit with respect to the proportion of such polar groups in the substituent is approximately 10% based on the weight of the hydrocarbon portion of the substituent.

The sources of the hydrocarbon substituent include principally the high molecular weight saturated petroleum fractions and substantially saturated olefin polymers, particularly polymers of mono-olefins having from about 2 to about 30 carbon atoms. Particularly useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by olefins such as 2-butene, 3-pentene, and 4-octene.

Also useful are the interpolymers of olefins such as those illustrated above with other interpolymerizable olefinic substances such as aromatic olefins, cyclic olefins, and polyolefins. The interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene: isobutene with styrene and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include the copolymer of 95% (by weight) of isobutene with 5% of styrene; the terpolymer of 98% of isobutene with 1% of piperylene and 1% of chloroprene; the terpolymer of 95% isobutene with 2% of 1-butene and 3% of 1-hexene; the terpolymer of 80% of isobutene with 1-pentene and 1-octene; the copolymer of 80% of 1-hexene and 20% of 1-heptene; the terpolymer of 90% of isobutene with 2% of cyclohexene and 8% of propene; and the copolymer Of 80% of ethylene and 20% of propene.

Another source of the hydrocarbon radical comprises saturated aliphatic hydrocarbons such as highly refined high molecular weight white oils or synthetic alkanes such as are obtained by hydrogenation of high molecular weight olefin polymers illustrated above or high molecular weight olefinic substances.

The use of olefin polymers having molecular weight of about 750–5,000 is preferred. Higher molecular weight olefin polymers having molecular weights from about 10,000 to about 100,000 or higher have been found to impart also viscosity index improving properties to the final products. The use of such higher molecular weight olefin polymers often is desirable.

The alkylene amines conform for the most part to the formula

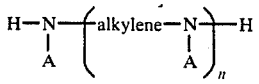

wherein n is an integer preferably less than about 10, A is a hydrocarbon or hydrogen radical, and the alkylene radical is preferably a lower alkylene radical having less than about 8 carbon atoms. The alkylene amines include principally methylene amines, ethylene amines, butylene amines, propylene amines, pentylene amines, hexylene amines, heptylene amines, octylene amines, other polymethylene amines, and also the cyclic and the higher homologues of such amines such as piperazines and aminoalkyl-substituted piperazines. They are exemplified specifically by: ethylene diamine, triethylene tetramine, propylene diamine, decamethylene diamine, octamethylene diamine, di(heptamethylene)triamine, tripropylene tetraamine, tetraethylene pentaamine, trimethylene diamine, pentaethylene hexamine, di-(trimethylene)-triamine, 2-heptyl-3-(2-aminopropyl)-imidazoline, 4-methylimidazoline, 1,3-bis(2-aminoethyl)-imidazoline, 1-(2-aminopropyl)-piperazine, 1,4-bis(2-aminoethyl)piperazine, and 2-methyl-1-(2-aminobutyl)-piperazine. Higher homologues such as are obtained by condensing two or more of the above-illustrated alkylene amines likewise are useful.

The ethylene amines are especially useful. They are described in some detail under the heading "Ethylene Amines" in the *Encyclopedia of Chemical Technology,* Kirk and Othmer, Volume 5, pages 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products can be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)-ethylene diamine, N,N'-bis-(2-hydroxyethyl)-ethylene diamine, 1-(2-hydroxyethyl)-piperazine, mono-hydroxypropyl-substituted diethylene triamine, 1,4-bis-(2-hydroxypropyl)-piperazine, dihydroxypropylsubstituted tetraethylene pentamine, N-(3-hydroxypropyl)-tetramethylene diamine, and 2-heptadecyl-1-(2-hydroxyethyl)-imidazoline.

Higher homologues obtained by condensation of the above-illustrated alkylene amines or hydroxy alkyl-substituted alkylene amines through amino radicals or through hydroxy radicals are likewise useful. It will be appreciated that condensation through amino radicals results in a higher amine accompanied with removal of ammonia and that condensation through the hydroxy radicals results in products containing ether linkages accompanied with removal of water.

The nonacidic acylated nitrogen compound is characterized by a nitrogen atom attached to the succinic radical. The linkage between a nitrogen atom and a succinic radical can be representative of an amide, imide, amidine, or ammonium-carboxylic acid salt structure. Thus, the nonacidic, acylated nitrogen compositions are characterized by amide, amide-salt, imide, amidine, or salt linkages and in many instances a mixture of such linkages.

A convenient method for preparing the acylated nitrogen compound comprises reacting a high molecular weight succinic acid compound characterized by the presence within its structure of a high molecular weight group having at least 90 aliphatic carbon atoms and at least one succinic acid-producing group. Such compounds are illustrated by the structural configuration:

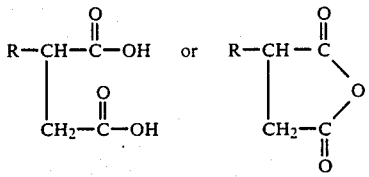

wherein R is a substantially hydrocarbon radical having at least about 50 aliphatic carbon atoms.

The reaction between the succinic acid compound and the alkylene amine results in the direct attachment of the nitrogen atoms to the succinic radical. As indicated previously, the linkage formed between the nitrogen atom and the succinic radical may thus be that representative of a salt, amide, imide, or amidine radical. In most instances the acylated nitrogen intermediate contains a mixture of linkages representative of such radicals. The precise relative proportions of such radicals usually are not known as they depend to a large measure upon the reactants used and also upon the environment (e.g., temperature) in which the reaction is carried out. To illustrate, the reaction involving an acid or anhydride group with an amino nitrogen-containing radical at relatively low temperatures such as below about 60° C. results predominantly in a salt linkage, i.e.,

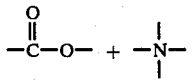

but at relative high temperatures as above about 80° C. results predominantly in an amide, imide, or amidine linkage, i.e.,

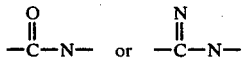

In any event, however, the product obtained by the above reaction, irrespective of the nature or relative proportions of the linkages present therein, must be substantially nonacidic, i.e., having an acid number less than 10 as measured by titration with phenolphthalein as the indicator. The succinic acids or anhydrides are readily available from the reaction of maleic anhydride with a high molecular weight olefin or a chlorinated hydrocarbon such as the olefin polymer described hereinabove. The reaction involves merely heating the two reactants at a temperature from about 100° C. to about 200° C. The product from such a reaction is an alkenyl succinic anhydride. The alkenyl group can be hydrogenated to an alkyl group. The anhydride can be hydrolyzed by treatment with water or steam to the corresponding acid.

In lieu of the olefins or chlorinated hydrocarbons, other hydrocarbons containing an activating polar substituent, i.e., a substituent which is capable of activating the hydrocarbon molecule in respect to reaction with maleic acid or anhydride, can be used in the above-illustrated reaction for preparing the succinic compounds. Such polar substituents may be illustrated by sulfide, disulfide, nitro, mercaptan, bromine, ketone, or aldehyde radicals. Examples of such polar-substituted hydrocarbons include polypropene sulfide, di-polyisobutene disulfide, nitrated mineral oil, di-polyethylene sulfide, brominated polyethylene, etc. Another method useful for preparing the succinic acids and anhydrides involves the reaction of itaconic acid with a high molecular weight olefin or a polar-substituted hydrocarbon at a temperature usually within the range from about 100° C. to about 200° C.

The reaction by which the nonacidic nitrogen product is formed is usually carried out by heating a mixture of the succinic acid compound and the alkylene amine at a temperature above about 80° C., preferably within the range from about 100° C. to about 250° C. However, the process may be carried out at a lower temperature such as room temperature to obtain products having predominantly salt linkages or mixed salt-amide linkages. Such products may be converted, if desired, by heating to above 80° C. to products having predominantly amide, imide, or amidine linkages. The use of a solvent such as benzene, toluene, naphtha mineral oil, xylene, n-hexane, or the like is often desirable in the above process to facilitate the control of the reaction temperature.

The relative proportions of the succinic acid compound and the alkylene amine reactants to be used in the above process are such that at least about a stoichiometrically equivalent amount of the alkylene amine reactant is used for each equivalent of the succinic acid compound used. In this regard it will be noted that the equivalent weight of the alkylene amine is based upon the number of the nitrogen-containing radicals. Similarly, the equivalent weight of the succinic acid is based upon the number of the carboxylic acid radicals present in its molecular structure. Thus, ethylene diamine has 2 equivalents per mole; triethylene tetraamine has 4 equivalents per mole; a mono-succinic acid (or anhydride) has 2 equivalents per mole, etc.

The upper limit of the useful amount of the alkylene amine reactant appears to be about 2 moles for each equivalent of the succinic acid compound used. Such amount is required, for instance, in the formation of products having predominantly amidine linkages. On the other hand, the lower limit of about one equivalent of the alkylene amine reactant used for each equivalent of the succinic acid compound is based upon the stoichiometry for the formation of products having predominantly amide linkages or mixed acid-amide linkages. In most instances, the preferred amount of the alkylene amine reactant is from about 1.1 to 5 equivalents for each equivalent of the succinic acid compound used.

Alternatively, the dispersancy can be provided by up to 10 (wt) % of a polymeric viscosity index improver dispersant. preferably up to 1.5 (wt) % in the lubricating oil composition. Concentration of a polymeric viscosity index improver dispersant in a concentrate of a lubricating oil composition is in the range of from about 0 to about 20 (wt) %, preferably from about 0 to about 8 (wt) %.

The viscosity index improver useful in the lubricating oil formulation most preferably is a dispersant viscosity index improver although, less preferably, a non-dispersant viscosity index improver can be used. Most preferably, a dispersant viscosity index improver is used in the lubricating oil formulation with an ashless dispersant although, less preferably, the dispersant viscosity index improver can be used in the lubricating oil formulation in the absence of an ashless dispersant. If a non-dispersant viscosity index improver is used in the lubricating oil formulation, it is preferably used with an ashless dispersant although, less preferably, a nondispersant viscosity index improver can be used in the absence of an ashless dispersant. The lubricant oils can contain from 0 to 10 (wt) %, preferably from 0 to 1.5 (wt) % of these viscosity index improvers, and from about 0 to about 20 (wt) % in the lubricating oil composition concentrate, without a major amount of base oil, preferably from about 0 to about 8 (wt) %. It should be noted that the ashless dispersant, if the viscosity requirements of the lubricating oil formulation are less stringent, may be used separately in the formulation in the absence of either a dispersant viscosity index improver or a nondispersant viscosity index improver.

Dispersant VI improvers can be formed from olefin copolymers or acrylate polymers by reacting with nitrogen compounds by direct reactions or grafting.

Examples of suitable viscosity index improver dispersants include:

(a) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons;

(b) polymers of $C_2$ to $C_{20}$ olefin with unsaturated $C_3$ to $C_{10}$ mono- or di-carboxylic acid neutralized with amine, hydroxy amine, or alcohols;

(c) polymers of ethylene with a $C_3$ to $C_{20}$ olefin further reacted either by grafting $C_4$ to $C_{20}$ unsaturated nitrogen-containing monomers thereon or by grafting an unsaturated acid onto the polymer backbone and then reacting said carboxylic acid groups with amine, hydroxy amine, or alcohol; and (d) polymers of ethylene and a $C_3$ to $C_{20}$ olefin further reacted first with oxygen and subsequently with formaldehyde and an amine.

It is preferred that the viscosity index improver dispersant have a number average molecular weight range, as by vapor-phase osmometry, membrane osmometry, or gel permeation chromatography, of 1,000 to 2,000,000, preferably 5,000 to 250,000, and most preferably 10,000 to 200,000. It is also preferred that the polymers of group (a) comprise a major weight amount of unsaturated ester and a minor amount, e.g., 0.1 to 40 weight percent, preferably 1 to 20 weight percent of a nitrogen containing unsaturated monomer, said weight percent based on total polymer. Preferably, the polymer group (b) comprises 0.1 to 10 moles of olefin, preferably 0.2 to 5 moles $C_5$–$C_{20}$ aliphatic or aromatic olefin moieties per mole of unsaturated carboxylic acid moiety, with from 50 percent to 200 percent of the acid moieties being neutralized. Preferably, the polymer of group (c) comprises an ethylene copolymer of 25 to 80 weight percent ethylene with 75 to 80 weight percent $C_3$ to $C_{20}$ mono- and/or di-olefin, 100 parts by weight of ethylene copolymer being grafted with either 0.1 to 40, preferably 1 to 20, parts by weight unsaturated nitrogen containing monomer, or being grafted with 0.10 to 5 parts by weight of unsaturated $C_3$ to $C_{10}$ mono- or di-carboxylic acid, which acid is 50 percent or more neutralizer. Preferably, the polymer of group (d) comprises an ethylene copolymer of 25 to 80 weight percent etnylene with 75 to 80 weight percent $C_3$ to $C_{20}$ mono- and/or diolefin.

The unsaturated carboxylic acids used in (a), (b), (c) and (d) above will preferably contain 3 to 10, more usually 3 or 4, carbon atoms and may be mono carboxylic such as methacrylic and acrylic acids or dicarboxylic such as maleic acid, maleic anhydride, fumaric acid, etc.

Examples of unsaturated esters that may be used include aliphatic saturated mono alcohols of at least 1 carbon atom, and preferably of from 12 to 20 carbon atoms such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures tnereof.

Otner esters include the vinyl alcohol esters of $C_2$ to $C_{22}$ fatty or monocarboxylic acids, preferably saturated such as vinyl acetate, vinyl laurate, vinyl palmitate, vinyl stearate, vinyl oleate, and the like and mixtures thereof.

Examples of suitable unsaturated nitrogen-containing monomers containing 4 to 20 carbon atoms which can be used in (a) and (c) above include the amino substituted olefins such as p-(beta-dimethylaminoethyl)styrene; basic nitrogen-containing heterocycles carrying a polymerizable ethylenically unsaturated substituent, e.g., the vinyl pyridines and the vinyl alkyl pyridines such as 2-vinyl-5-ethyl pyridine; 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, and particularly when they are N-vinyl pyrrolidones or N-vinyl piperidones. The vinyl radical preferably is unsubstituted ($CH_2$—CH—), but it may be mono-substituted with an aliphatic hydrocarbon group of 1 to 2 carbon atoms, such as methyl or ethyl.

The vinyl pyrrolidones are the preferred class of N-vinyl lactams and are exemplified by N-vinyl pyrrolidone, N-(1-methylvinyl) pyrrolidone, N-vinyl-5-methyl pyrrolidone, N-vinyl-3,3-dimethyl pyrrolidone, N-vinyl-5-ethyl pyrrolidone, N-vinyl-4-butyl pyrrolidone, N-ethyl-3-vinyl pyrrolodone, N-butyl-5-vinyl pyrrolidone, 3-vinyl pyrrolidone, 4-vinyl pyrrolidone, 5-vinyl pyrrolidone, and 5-cyclohexyl-N-vinyl pyrrolidone.

Examples of olefins which could be used to prepare the copolymers of (b) and (c) above include monoolefins such as propylene, 1-butene, 1-pentene, 1-hexene, 1-heptene, 1-decene, 1-dodecene, styrene, etc.

Representative nonlimiting examples of diolefins that can be used in (c) include 1,4-hexadiene, 1,5-heptadiene, 1,5-octadiene, 5-methyl-1-4-hexadiene, 1,4-cyclohexadiene, 1,5-cyclo-octadiene, vinyl-cyclohexane, dicyclopentenyl, and 4,4'-dicyclohexenyl such as tetrahydroindene, methyl tetrahydroindene, dicyclopentadien, bicyclo-(2,2,1)-hepta-2,5-diene, alkenyl, alkylidiene, 5-methylene--2-norbornene, and 5-ethylidene-2-norbornene.

Typical polymeric viscosity index improver dispersants include copolymers of alkyl methacrylates with N-vinyl pyrrolidone or dimethylaminoalkyl methacrylate, alkyl fumarate-vinyl acetate, N-vinyl pyrrolidine copolymers, post-grafted interpolymers of ethylene-propylene with an active monomer such as maleic anhydride which may be further reacted with an alcohol or an alkylene polyamine, e.g., see U.S. Pat. Nos. 4,059,794, 4,160,739, and 4,137,185; or copolymers of ethylene and propylene reacted or grafted with nitrogen compounds such as shown in U.S. Pat. Nos. 4,068,056, 4,063,058, 4,146,439, and 4,149,984; and styrene/maleic anhydride polymers postreacted with alcohols and amines, ethoxylated derivatives of acrylate polymers, for example, see U.S. Pat. No. 3,702,300.

Lubricating oil formulations can also contain nondispersant viscosity index improvers. The non-dispersant viscosity index improvers can be used separately in the formulation without a dispersant, or in the presence of an ashless dispersant.

The lubricating oil composition can contain from 0 to about 10 (wt) %, preferably from 0 to about 1.5 (wt) %, of these non-dispersant viscosity index improvers. A lubricating oil composition concentrate, without a major amount of base oil, can contain from about 0 to about 20 (wt) %, preferably from about 0 to about 8 (wt) %, of the non-dispersant viscosity index improvers.

Non-dispersant polymeric viscosity index improvers can be selected from the group of non-dispersant viscosity index improvers consisting of olefin copolymers, acrylate polymers, hydrogenated copolymers and hydrogenated styrene copolymers. All these are discussed in more detail in paragraphs 1–3 herewith below.

1. Olefin copolymers such as addition polymers of ethylene and propylene. Termonomers, such as 5-ethylidene norbornene or norbornadiene, can be used, as can more than one termonomer be used.

2. Acrylate polymers which are addition polymers of acrylate or methacrylate esters. Examples of these are illustrated in U.S. Pat. No. 4,089,794 incorporated herein by reference.

3. Hydrogenated copolymers and hydrogenated styrene copolymers such as partially hydrogenated copolymers of butadiene or isoprene and styrene. Aromatic unsaturation is maintained while alkenes are hydrogenated.

The zinc dialkyldithiophosphates can be selected from the group of zinc dialkyldithiophosphates wherein (1) the alcohol reactant is a primary alcohol or mixture of primary alcohols, (2) the alcohol reactant is a secondary alcohol such as isopropanol or methyl-isobutylcarbanol and mixtures of secondary alcohols, (3) an aryl reactant is used such as a phenol, alkyl phenol, or mixtures of alkyl phenols, (4) mixtures of primary and secondary alcohols, and (5) mixtures of primary or secondary alcohols with alkylaryl compounds.

Polyvalent metal salts of diorgano dithiophosphoric acid wherein the organo groups contain in the range of from about 1 to about 30 carbon atoms are well-known in the art as additives for lubricating oil compositions. Metal salts of this type, and especially the zinc salts, are particularly useful as antiwear and antioxidant additives for lubricating oils that are intended for use in the crankcases of internal combustion engines. The nickel salts have been similarly employed, as have those of cadmium and lead. In addition, other polyvalent metal salts of these acids, particularly the salts of calcium, barium, and magnesium, are applicable in automotive oils, industrial oils, marine turbine oils, hydraulic oils, and the like, functioning in many instances as detergents and dispersants, as well as antioxidants, extreme pressure agents, and antiwear additives.

It is common practice to prepare dialkyl dithiophosphoric acids by reaction of aliphatic alcohols with phosphorus pentasulfide. The metal salts are then obtained by neutralizing the acids with an oxide, hydroxide, or carbonate of the desired polyvalent metal or, alternatively, with a reactive polyvalent metal salt.

Related diorgano dithiophosphoric acids may be prepared by reacting alkyl phenols, aryl-substituted alcohols, naphthenyl alcohols, cycloaliphatic alcohols, and the like, with $P_2S_5$, and the resulting acids may be converted to their metal salts in much the same manner as with the dialkyl dithiophosphoric acids.

Another practice is to accelerate the neutralization of diorgano dithiophosphoric acids with metal oxides, hydroxides, or carbonates, and particularly with metal oxides, by adding to the reaction mixture a catalytic amount, i.e., from about 1 to about 10 wt. % percent, based on the weight of organo dithiophosphoric acid, of a water-soluble fatty acid or a water-soluble metal salt of a fatty acid of from 1 to 5 carbon atoms. The acid used must be a weaker acid than the dialkyl dithiophosphoric acid being neutralized. The lower fatty acids of from 1 to 5 carbon atoms include formic, acetic, propionic, butyric, pentanoic, trimethyl acetic, etc. The metal salts of those acids that may be used include those of calcium, barium, lead, cadmium, copper, zinc, aluminum, and magnesium.

The diorgano dithiophosphoric acids that are useful in the process of the present invention may be characterized by the following general formula:

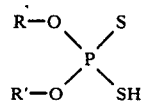

wherein R and R' may be the same or different organo groups having from about 1 to about 30 carbon atoms.

In preparing the diorgano dithiophosphoric acid, normally about 4 moles of hydroxy compound (alcohol, alkyl phenol, etc.) or a mixture of such compounds, is reacted with about 1 mole of phosphorus pentasulfide. The hydroxy compounds should be essentially free of water. Reaction temperatures are normally in the range of from about 50° to about 300° F., and reaction times may range from about 1 to about 6 hours. One convenient method for determining the end point of the reaction is to measure the specific gravity of the reaction product. This will of course vary with the reaction temperature and other factors but can be determined beforehand for any particular reaction system.

For example, mixed dialkyl dithiophosphoric acids can be prepared by reacting 35 weight percent of primary amyl alcohols and 65 weight percent of isobutyl alcohol with phosphorus pentasulfide, using a mole ratio of alcohol to $P_2S_5$ of 4 to 1. The reaction is conducted at about 170° F. for a period of from 3 to 4 hours until a specific gravity of about 1.04 to 1.05 is attained, measured at 78° F. The end point of the reaction can also be determined by noting when the evolution of $H_2S$ has ceased. As soon as the end point has been reached, the reaction product is then cooled to a temperature below 100° F., preferably while being stripped with an inert gas such as nitrogen to remove traces of $H_2S$. The product is then filtered.

Among the aliphatic alcohols that can be employed in preparing diorgano dithiophosphoric acids for use in this invention are included not only the simple alcohols such as isopropyl, normal butyl, isobutyl, methyl isobutyl carbinyl, n-decyl, and so on, but also mixed alcohols such as $C_5$, $C_8$, or $C_{13}$ oxo alcohols obtained by reaction of olefins with carbon monoxide and hydrogen and subsequent hydrogenation of the resultant aldehydes, and those obtained by the hydrogenation of natural fats and oils. For example, mixed alcohols in the $C_5$–$C_{18}$ range, consisting chiefly of lauryl alcohol, can be obtained by hydrogenating coconut oil, and are sold under the trade name "Lorol." Mixed $C_{12}$–$C_{20}$ alcohols, consisting principally of $C_{16}$ and $C_{18}$ alcohols, can be obtained from tallow by hydrogenation and/or by sodium reduction. Primary alcohols of 22 carbon atoms or more can be obtained by the hydrolysis of Ziegler-type ethylene polymers and are available commercially from Continental Oil Co. under the name of Alfol alcohols. All of these higher alcohols can be used for dialkyl dithiophosphate manufacture.

Organo dithiophosphoric acids for use in the invention can also be prepared from cycloaliphatic alcohols such as methylcyclohexanol, ethyl-cyclopentanol, cyclohexanol, methylcycloheptanol, and the like, as well as naphthenyl alcohols obtained by carboxylic reduction of naphthenic acids and their esters, e.g., by hydrogenation or sodium reduction of ethyl esters of naphthenic acids.

Representative aryl, alkaryl and aralkyl hydroxy compounds useful in preparing organo dithiophosphoric acids for the present invention include phenol, cresol, naphthol, amyl phenol, tert. octyl phenol, benzyl alcohol and phenyl butanol.

The diorgano phosphates suitable for use in our invention include not only those derived from single hydroxy organic compounds but also mixed diorgano dithiophosphates. The latter can be prepared either by reacting each organo hydroxy compound separately with $P_2S_5$ and then mixing the resulting acids for the neutralization step or by reacting mixtures of the organo hydroxy compounds with $P_2S_5$ so that at least a portion of the product will have molecules in which two different organo groups will be present. For example, mixed diorgano dithiophosphates may be prepared from p-tert. amyl phenol and $C_8$ oxo alcohols; from a mixture of mixed amyl alcohols and technical lauryl alcohol (e.g., Lorol); from isopropyl alcohol and $C_{13}$ oxo alcohols; from isobutyl alcohol and mixed primary amyl alcohols; from methylcyclohexanol and tert. octyl phenol; or from a mixture of isopropyl alcohol, methylisobutyl carbinol and $C_5$ oxo alcohols.

To convert the organo dithiophosphoric acids to their metal salts, a metal oxide, hydroxide, or carbonate such as ZnO, BaO, $Ba(OH)_2''5H_2O$, $CaCO_3$, $Ca(OH)_2$, $PbCO_3$, etc. is added to the dithiophosphoric acids until it is determined that the proper neutralization has been effected, as for example by measuring the pH of the product. Then a diluent oil may be added to produce a concenterate of the metal salts which may be later blended in the proper concentration in a finished lubricating oil composition. After the diluent oil has been added the salts may be stabilized by heating for a period of time, and then the concentrate may be filtered and dried by stripping with an inert gas.

Ideally, the amount of metal oxide or its equivalent that is needed to obtain proper neutralization of the diorgano dithiophosphoric acids approximates a stoichiometric quantity. However, in actual practice in the past it has been necessary to employ an excess. For example, in the case of zinc salt preparation 5 or more weight percent excess zinc oxide has been needed to obtain the desired degree of neutralization. Essentially no excess metal oxide is required, provided as stated a catalytic quantity of a weak acid or a salt of a weak acid is present in the reaction mixture.

The ash-containing detergents are exemplified by neutral and overbased salts of alkali and alkaline earth metals with sulfonic acids or carboxylic acids or other organic acids. These can be present for example as the metal salts of sulphonic acids, alkyl phenols, sulphurized alkyl phenols, alkyl salicylates, naphthenates, and other oil soluble mono- and di-carboxylic acids. The most commonly used salts of such acids are those of sodium, potassium, lithium, calcium, magnesium, strontium, and barium. The term "overbased" is applied to designate the metal salts wherein the metal is present in stoichiometrically larger amounts than the organic acid radical. The sulfonic acids can be derived from petroleum sulfonic acids such as alkylbenzene sulfonic acids. Examples of organic acid salts include overbased phenates, both low base phenates of total base number (TBN) of 80–180 TBN and high-base phenates of about 250 TBN. Salicylates can also be used. These are prepared by reacting alkali or alkaline earth metal bases with alkyl salicylic acids. TBNs can range from about 120 to about 250.

The overbased sulfonates are typically barium, magnesium, calcium or sodium sulfonates. Barium sulfonates are made from alkylbenzene sulfonic acids. Magnesium sulfonates are made from alkylbenzene sulfonic acids and typically will have a TBN of about 400 with a sulfonate soap content of about 28%. Calcium sulfonates are made from alkylbenzene sulfonic acids and typically will have TBNs ranging from 300–400 with sulfonate soap contents ranging from about 20–30%. Sodium sulfonates are made from alkylbenzene sulfonic acids and typically will have TBNs of about 400 and a soap content of about 18%. Low-base sulfonates are typically calcium sulfonate made from alkylbenzene sulfonic acids and tyically will have TBNs of 15 to 40 and a soap content of about 40%.

The commonly employed methods for preparing the basic salts involves heating a mineral oil solution of an acid with a stoichiometric excess of a metal neutralizing agent such as the metal oxide, hydroxide, carbonate, bicarbonate, or sulfide at a temperature about 50° C. and filtering the resulting mass. The use of a "promoter" in the neutralization step and the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, Cellosolve, Carbitol, ethylene glycol, stearyl alcohol, and cyclohexyl alcohol, amines such as aniline, phenylenediamine, phenothamine, phenyl beta-naphthylamine, and dodecylamine. A particularly effective method for preparing the basic salts comprises mixing an acid with an excess of a basic alkaline earth metal neutralizing agent, a phenolic promoter compound, and a small amount of water and carbonating the mixture at an elevated temperature such as 60°–200° C.

The metal complexes are especially adapted for use in combination with extreme pressure and corrosion-inhibiting additives such as metal dithiocarbamates, xanthates, the Group II metal phosphorodithioates and their epoxide adducts, hindered phenols, sulfurized cycloalkanes, di-alkyl polysulfides, sulfurized fatty esters, phosphosulfurized fatty esters, alkaline earth metal salts of alkylated phenols, dialkyl phosphites, triaryl phosphites, and esters of phosphorodithioic acids. Combinations of the substituted polyamines of this invention with any of the above-mentioned additives are especially desirable for use in lubricants which must have superior extreme pressure and oxidation-inhibiting characteristics.

Ashless rust inhibitors are a large class of organic surfactants that are used in conjunction with high-base sulfonates. Examples are ethoxylated nonylphenol, ethylene oxide-propylene oxide copolymers and derivatives. Pour point depressants are used to maintain good low temperature properties of the oil such as pour points, pumpability and cold cranking. They are typically acrylate or methacrylate polymers.

Additional antioxidants are used to supplement the antioxidant properties of zinc dialkyldithiophosphates, phenate, and salicylates. Examples are hindered phenols such as 2,6 di-tert-butyl 4-alkyl phenols or substituted methylene-bis-phenols; arylamines including alkylated diphenyl amines; sulfurized olefins; sulfurized carboxylate unsaturated esters containing olefin groups; sulfurized carboxylate salts; and oil soluble transition metal compounds selected from oil soluble transition metal compounds of 3 to 20 carbon atoms which reduce viscosity increases in oils subjected to oxidizing conditions. Suitable examples include copper and molybdenum carboxylates as well as cobalt and nickel compounds.

Supplemental antioxidants can be contained in the lubricating oil composition in a range from about 0.1 to about 2.0 (wt) %, preferably from about 0.2 to about 1.0 (wt) %. In a lubricating oil composition concentrate, without a major amount of base oil present, a supplemental antioxidant can be present in a range from about 1.0 to about 20 (wt) %, preferably from about 2 to about 10 (wt) %.

Additional friction modifiers to supplement the reduction of friction of metal to metal contact can be used. Friction modifiers can be selected from the group consisting of fatty acid derivatives including: esters such as triglycerides or monoesters from polyols, as glycerol monooleate and pentaerythritol monooleate, amides such as oleamide or amides made from polyamines or alkanol amines; and heterocycles made by condensing compounds such as aminoguanidine with carboxylic acids to form triazoles.

Friction modifiers can also be molybdenum compounds as oil-soluble compounds or dispersions. Typically, the most active compounds contain sulfur. Suitable examples include molybdenum thiophosphonates, molybdenum carboxylates, molybdenum dithiophosphates, molybdenum amine complexes, molybdenum disulfide, etc.

Useful friction modifiers can be synergistic combinations of additives such as sodium sulfonates and glycerol monooleate or other fatty acid derivatives. Combinations can include mixed fatty acid derivatives or mixtures of molybdenum compounds and fatty acid derivatives and mixtures of the above-named compounds.

Friction modifiers can be present in the lubricating oil composition in the range from about 0.1 to about 2.0 (wt) %, preferably from about 0.2 to about 1.0 (wt) %. In a lubricating oil composition concentrate, without a major amount of base oil present, a friction modifier can be present in an amount from about 1.0 to about 20 (wt) %, preferably from about 2 to about 10 (wt) %.

The reaction by which the dispersant/detergent and rust, corrosion and oxidation inhibitors is prepared is an essential element of our invention. The unique advantage of our novel composition as verified by the data obtained from bench test and engine test performance has been found to be correlated to the method of reacting the selected copper compound and the overbased sulfonate or overbased phenate or overbased salicylate to obtain the overbased copper sulfonate or copper phenate or copper salicylate or mixtures thereof.

The copper compound suitable in our process can be any copper carboxylate of from 1 to 6 carbon atoms, preferably copper acetate.

Preparation of an overbased copper magnesium sulfonate is an example of an essential element of our invention. A suitable copper compound is added to an overbased alkali or alkaline earth sulfonate or phenate or salicylate and refluxed in an alcohol solvent. The composition of the reaction product is not understood but the oil-insoluble compound is incorporated into the overbased product. By an oilinsoluble copper compound we mean one that is not soluble in oil under normal blending conditions.

The reaction product is formed due to slight solubility of the copper compound in alcohols. The alcohol-soluble copper compound then reacts with the overbased alkali or alkaline earth metal carbonate or hydroxide present in the overbased product. Thus, the copper is incorporated into the colloidally dispersed metallic carbonate or hydroxide.

This invention accordingly comprises a lubricating oil composition preferably comprising: (a) a major amount of a lubricating oil; (b) from 0 to 10 (wt) % of an ashless dispersant compound; (c) 0 to 10 (wt) % of at least one viscosity index improver selected from the group consisting of a nitrogen-containing polymeric viscosity index improver dispersant, an ester-containing polymeric viscosity index improver dispersant, and a non-dispersant viscosity index improver; and (d) from 0.01 to 10.0 parts by weight per 100 parts of said lubricating oil composition of zinc dialkyldithiophosphate and characterized in that the lubricant oil composition further contains from 0.1 to 5.0 (wt) % of a dispersant/detergent, antioxidant, and corrosion inhibitor comprising a copper overbased metal-containing composition wherein said ashless dispersant can be (A) a nitrogen- or ester-containing dispersant compound selected from the group consisting of: (i) oil soluble salts, amides, imides, oxazolines, and esters, or mixtures thereof, of long chain hydrocarbonsubstituted mono- and dicarboxylic acids or their anhydrides; (ii) long chain aliphatic hydrocarbon having a polyamine attached directly thereto; and (iii) Mannich condensation products formed by condensing about a molar proportion of long chain hydrocarbon substituted phenol with about 1 to 10 moles of formaldehyde and about 0.5 to 2 moles of polyalkylene polyamine; wherein said long chain hydrocarbon group is a polymer of a $C_2$ to $C_5$ monoolefin, said polymer having a molecular weight of about 700 to about 5000; or (B) from 0 to 10 (wt) % of a nitrogen- or ester-containing polymeric viscosity index improver dispersant, preferably from about 0.4 to about 1.5 (wt) %, which includes: (1) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons; (2) polymers of $C_2$ to $C_{20}$ olefin with unsaturated $C_3$ to $C_{10}$ mono- or di-carboxylic acid neutralized with amine, hydroxy amine, or alcohols; (3) polymers of ethylene with a $C_3$ to $C_{20}$ olefin further reacted either by grafting $C_4$ to $C_{20}$ unsaturated nitrogen-containing monomers thereon, or by grafting an unsaturated acid onto the polymer backbone and then reacting said carboxylic acid groups with amine, hydroxy amine or, alcohol; and (4) polymers of ethylene and a $C_3$ to $C_{20}$ olefin further reacted first with oxygen and subsequently with formaldehyde and an amine; or (C) mixtures of (A) and (B); wherein said ashless dispersant can be a Mannich condensation product comprising the product of reactants in the mole ratio of about 1 mole of polyisobutenylphenol with from about 1 to 10 moles of formaldehyde and from about 0.5 to about 2 moles of polyethylenepolyamine and from about 0.1 to about 1.0 moles of a $C_6$ to $C_{100}$ alkanoic or sulfonic acid, and wherein said Mannich condensation product can be borated with from about 0.1 to about 5.0 moles boron per mole of polyisobutenylphenol; wherein said ashless dispersant can comprise the reaction product of polyisobutenyl succinic anhydride with an amine selected from the group consisting of ethoxylated polyalkylpolyamines, propoxylated polyalkylpolyamines, and polyethylene polyamines; wherein said ashless dispersant reaction product of polyisobutenyl succinic anhydride with an amine can be borated with a boron compound; wherein said composition can contain a non-dispersant viscosity index improver selected from the group consisting of olefin copolymers, acrylate polymers, hydrogenated copolymers and hydrogenated styrene copolymers; wherein said composition can contain an overbased alkyl phenate or overbased sulfurized alkyl phenate selected from the group of magnesium phenates, calcium phenates, and sodium phenates and mixtures thereof; wherein said composition can contain an overbased salicylate selected from the group of magnesium salicylate, calcium salicylate, and sodium salicylate or mixtures thereof; wherein said composition can contain an overbased sulfonate selected from the group consisting of magnesium sulfonates, calcium sulfonates, and sodium sulfonates or mixtures thereof; wherein said zinc dialkyldithiophosphate can be selected from the group consisting of compounds prepared from secondary alcohols, primary alcohols, phenols, alkylphenols, mixtures of alkylphenols, and mixtures of secondary alcohols, primary alcohols, phenols, and alkylphenols; wherein said composition can contain supplemental friction modifiers present in a range of from about 0.1 to about 2.0 (wt) %, preferably from about 0.2 to about 1.0 (wt) %, selected from the group consisting of glycerol monooleate, pentaerythritol monooleate, oleamide, amides derived from polyamines and alkanol amines, triazoles derived from aminoguanidine and carboxylic acids, molybdenum thiophosphonates, molybdenum carboxylates, molybdenum dithiophosphates, molybdenum amine complexes, molybdenum disulfide and mixtures thereof; wherein said composition can contain supplemental antioxidants present in a range of from about 0.1 to about 2.0 (wt) %, preferably from about 0.2 to about 1.0 (wt) %, selected from the group consisting of hindered phenols, aryl amines, sulfurized olefins, sulfurized carboxylate unsaturated esters containing olefin groups; sulfurized carboxylate salts, and oil-soluble metal compounds selected from the group of oil-soluble salts of carboxylic acids of from 3 to 20 carbon atoms wherein said metal is copper, molybdenum, cobalt, or nickel; wherein said copper overbased metal-containing compound can be present as an overbased copper magnesium sulfonate in said composition within the range of from 0.1 (wt) % to 2.5 (wt) %; wherein said overbased copper metal-containing compound can be present as an overbased copper calcium sulfonate in said composition within the range of from 0.3 (wt) % to 2.5 (wt) %; wherein said overbased copper metal-containing compound can be present as an overbased copper calcium phenate in said composition within the range of from 0.1 (wt) % to 2.5 (wt) %; wherein said overbased copper metal-containing compound can be present as an overbased copper sodium sulfonate in said composition within the range of from 0.3 (wt) % to 2.5 (wt) %.

The invention further comprises a concentrate of a lubricating oil composition wherein said concentrate comprises (a) from 0 to 65 (wt) % of an ashless dispersant; (b) from about 0 to about 20 (wt) %, preferably from about 0 to about 8 (wt) %, of at least one viscosity index improver selected from the group consisting of a nitrogencontaining polymeric viscosity index improver dispersant, an ester-containing polymeric viscosity index improver dispersant, and a non-dispersant viscosity index improver; and (c) from 2 to 25 parts by weight of a zinc dialkyldithiophosphate and from 5 to 25 (wt) % of a dispersant/detergent, antioxidant, and corrosion inhibitor comprising an overbased copper phenate, sulfonate, or salicylate; wherein said ashless dispersant can be (A) a nitrogen- or ester-containing dispersant compound selected from the group consisting of: (i) oil-soluble salts, amides, and esters, or mixtures thereof, of long chain hydrocarbon-substituted mono- and dicarboxylic acids or their anhydrides; (ii) long chain aliphatic hydrocarbon having a polyamine attached directly thereto; and (iii) Mannich condensation products formed by condensing about a molar proportion of long chain hydrocarbon-substituted phenol with about 1 to 10 moles of formaldehyde and about 0.5 to 2 moles of polyalkylene polyamine; wherein said long chain hydrocarbon group is a polymer of a $C_2$ to $C_5$ monoolefin, said polymer having a molecular weight of about 700 to about 5000; or (B) from about 0 to about 20 (wt) %, preferably from about 0 to about 8 (wt) %, of a nitrogen- or ester-containing polymeric viscosity index improver dispersant which includes: (1) polymers comprised of $C_4$ to $C_{24}$ unsaturated esters of vinyl alcohol or $C_3$ to $C_{10}$ unsaturated mono- or dicarboxylic acid with unsaturated nitrogen-containing monomers having 4 to 20 carbons; (2) polymers of $C_2$ to $C_{20}$ olefin with unsaturated $C_3$ to $C_{10}$ mono- or di-carboxylic acid neutralized with amine, hydroxy amine, or alcohols; (3) polymers of ethylene with a $C_3$ to $C_{20}$ olefin further reacted either by grafting $C_4$ to $C_{20}$ unsaturated nitrogen-containing monomers thereon or by grafting an unsaturated acid onto the polymer backbone and then reacting said carboxylic acid groups with amine, hydroxy amine, or alcohol; and (4) polymers of ethylene and a $C_3$ to $C_{20}$ olefin further reacted first with oxygen and subsequently with formaldehyde and an amine; or (C) mixtures of (A) and (B); wherein said ashless dispersant can comprise the reaction product of polyisobutenyl succinic anhydride with an amine selected from the group consisting of ethoxylated polyalkylpolyamines, propoxylated polyalkylpolyamines and polyethylenepolyamines; wherein said reaction product of polyisobutenyl succinic anhydride with an amine can be borated with a boron compound; wherein said concentrate can contain a non-dispersant viscosity index improver selected from the group consisting of olefin copolymers, acrylate polymers, hydrogenated copolymers and hydrogenated styrene copolymers; wherein said concentrate can contain an overbased phenate or overbased alkylphenol sulfide selected from the group consisting of magnesium phenates, calcium phenates, and sodium phenates or mixtures thereof; wherein said concentrate can contain an overbased salicylate selected from the group consisting of magnesium salicylates, calcium salicylates, or sodium salicylates; wherein said concentrate can contain an overbased sulfonate selected from the group consisting of magnesium sulfonates, calcium sulfonates, and sodium sulfonates; wherein said zinc dialkyldithiophosphate can be selected from the group consisting of compounds prepared from secondary alcohols, primary alcohols, phenols, alkylphenols, mixtures of alkylphenols, and mixtures of secondary alcohols, primary alcohols, phenols, and alkylphenols; wherein said concentrate can contain supplemental friction modifiers present in a range of from about 1 to about 20 (wt) %, preferably from about 2 to about 10 (wt) %, selected from the group consisting of glycerol monooleate, pentaerythritol monooleate, oleamide, amides derived from polyamines and alkanol amines, triazoles derived from aminoguanidine and carboxylic acids, molybdenum thiophosphonates, molybdenum carboxylates, molybdenum dithiophosphates, molybdenum amine complexes, molybdenum disulfide and mixtures thereof; wherein said concentrate can contain supplemental antioxidants present in a range of from about 1 to about 20 (wt) %, preferably from about 2 to about 10 (wt) %, selected from the group consisting of hindered phenols, aryl amines, sulfurized olefins, sulfurized carboxylate unsaturated esters containing olefin groups, sulfurized carboxylate salts, and oil-soluble metal compounds selected from the group of oil-soluble salts of carboxylic acids of from 3 to 20 carbon atoms wherein said metal is copper, molybdenum, cobalt, or nickel; wherein said copper overbased sulfonate can be present in said composition within the range of from 5 (wt) % to 25 (wt) %; wherein said copper overbased phenate can be present in said composition within the range of from 5 (wt) % to 25 (wt) %; wherein said copper overbased salicylate can be present in said composition within the range of from 5 (wt) % to 25 (wt) %.

The following examples illustrate the overbased copper-containing composition and the process of this invention.

EXAMPLE I

The following is an example of the preparation of an overbased magnesium sulfonate.

A suitable vessel was charged with a mixture of 69.7 g ammonium sulfonate, 101.6 g 5 W oil, and 400 ml of xylene. The mixture was stirred well at ambient temperatures and 43.5 g of magnesium oxide was added. After all of the magnesium oxide was added, the mixture was heated to about 100° F., and 26 ml of methanol was added by means of a dropping funnel. Heating was continued and at about 140° F., 42 ml of water was added by means of a dropping funnel. Heating continued until reflux conditions were obtained. The mixture was then refluxed for 90 min. After the 90 min. reflux period, distillation overhead removed all of the methanol and some water and xylene. At about 200° F., 19 ml of water was added while continuing to heat. At 225° F., heating was discontinued and cooling begun. The mixture was cooled to about 100° F. and then carbonated by blowing with $CO_2$ at 0.6 CFH. During the carbonation, 3.5 ml aliquots of water was added very 10 min. to give a total of 27 ml of water. Carbonation continued for a total of 2.5 hours. The excess water was then removed by rapid heating or flash stripping at 240° F. Residual unreacted MgO and MgO impurities were removed by centrifugation and/or filtration. Solvents were removed by heating to about 360° F. in the presence of a nitrogen strip or under vacuum. The resulting product had a TBN of about 400, a viscosity of about 200 cs at 210° F., and a magnesium sulfonate content of about 28 (wt) %.

EXAMPLE II

In the procedure of Example I, a copper magnesium sulfonate was prepared as Sample No. 10281-93 except that the copper acetate was added after the 90 min. reflux. The 8.0 g of copper acetate was slurried in 50 ml xylene and added to the reaction mass. The final product had a TBN of 407, a copper content of 0.91 (wt) %, and a viscosity of 320 cs at 210° F.

EXAMPLE III

In the procedure of Example I, a copper magnesium sulfonate was prepared as Sample No. 10281-102 except that the copper acetate was added after the magnesium oxide had been added and heating had begun and during the reflux step. The finished product had a TBN of 360, a copper content of 0.64 (wt) %, and a viscosity of 404 cs at 210° F.

EXAMPLE IV

In the procedure of Example I, a copper magnesium sulfonate was prepared as Sample No. 10281-128 except that the copper acetate was added after carbonation and removal of water. In this preparation 11.6 g of copper acetate was added along with 100 ml of methanol. This mixture was refluxed for about 30 min. and then the methanol was removed. Final clarification resulted in a product with a TBN of 406, a copper content of 1.34 (wt) %, and a viscosity of 97.1 cs at 210° F.

EXAMPLE V

A copper magnesium sulfonate was prepared. In the procedure of Example I, 8.06 g of copper acetate monohydrate was added at the same time the magnesium oxide was added. The final product, Sample No. 9430-84, was green, viscous clear material. It had a total base number of 423, a copper content of 1.04 (wt) %, and a viscosity of 73 cs at 210° F.

EXAMPLE VI

In the procedure of Example V, a copper magnesium sulfonate was prepared as Sample No. 9430-80. The final product was a green, viscous clear material. Total base number was 411, and copper content was 1.04 (wt) %.

EXAMPLES VII–X

In the procedure of Example VI, Samples 9430-81, 9430-61, 9430-151, and 8457-123 were prepared except that Example X was not carbonated. The final products were clear, green materials. Product characteristics were:

| | Sample No. | % (wt) Cu | TBN |
|---|---|---|---|
| Example VII | 9430-81 | 1.97 | 382 |
| Example VIII | 9430-61 | 1.48 | 198 |
| Example IX | 9430-151 | 0.98 | 398 |
| Example X | 8457-123 | 2.09 | — |

EXAMPLE XI

A copper magnesium sulfonate was prepared. A suitable vessel was charged with 156.6 g of C-20 ammonium sulfonate, 46.8 g of oil, and 370 ml of xylene.

The product was stirred while the mixture was blown with 2.5 CFH ammonia for 30 seconds to achieve 100% neutralization. At about 80° F., 43.5 g of magnesium oxide and 8.0 g of cupric acetate monohydrate were added and heating was begun. At about 98° F., 39 ml of methyl alcohol was added over about 5 min. Heating was continued and at 138° F., 42 ml of water was added. Heating was continued until reflux was achieved. The mixture was refluxed for 90 min. and then the overheads were removed while heating to a bottoms temperature of 227° F. During this final heating step, 18 ml of water was added at 200° F.

A total of 250 ml of xylene was added to the green opalescent mixture and it was then cooled to 100° F. Carbonation was begun after 6 ml of water was added and mixed well into the hydrate. A total of 27 ml of water was added over the first 90 min. of carbonation. A total of about 34 g of $CO_2$ was absorbed over a 150 min. carbonation period while delivering $CO_2$ to the mixture at about 0.25 g/min. The mixture was centrifuged to yield a total of 21 ml (normal is 10–14) of white solids. The solvent was then removed by heating to 360° F. with a nitrogen purge. Analysis was as follows:

| | |
|---|---|
| % Sulfonate (calc.) | 27.8 |
| TBN | 424 |
| Copper, (wt) % | 1.04 |
| Viscosity @ 210° F. cs | 131 |
| Clarity in Hexane, 15 (wt) % | G–H (unfiltered) |

Note: Clarity on scale of A to N. A is clear. N is opaque.

EXAMPLE XII

A copper magnesium sulfonate was prepared. A suitable five liter, three necked flask equipped for heating, reflux, mixing, etc., was charged with 1200 g High Base Magnesium Sulfonate—Amoco A-9218
1200 ml of xylene solvent
900 ml of methanol Mixing was begun after the charge was in the flask and 45.6 g of cupric acetate monohydrate (J. T. Baker Chemical Company, Phillipsburg, N.J.) was added. Heating was begun after all of the copper acetate monohydrate had been added. The mixture was heated to reflux (149° F.) and was allowed to reflux for 30 minutes. After the 30 minutes reflux period, the equipment was arranged for distillation and the methanol, some xylene, and a small amount of water were removed by heating to 260° F. The flask contents were cooled and 900 ml of xylene was added. The mixture was then filtered with 3% HYFLO Supercel admixed filter aid through a ¼ inch cake of the same filter aid. Filtration was very fast and easy. The solvents were then removed by heating the mixture to 360° F. and stripping with a small amount of nitrogen. This yielded 1226.3 g of a dark green oleaginous liquid which analyzed as follows:

| | |
|---|---|
| Total Base No. | 409.4 |
| Viscosity, cSt @ 212° F. | 92.2 |
| % Sediment | 0.03 |
| % Copper | 1.17 |
| Density | 1.105 |

EXAMPLE XIII

The following procedure is a typical preparation of a copper alkali metal sulfonate:

A suitable reactor was charged with:

100 g Lubrizol 6198-A 400 total base number sodium sulfonate
200 g xylene
100 ml methanol The above was mixed well and 3.8 g of copper acetate monohydrate was added. The mixture was heated to reflux and held at reflux (150° F.) for 30 min. The methanol was then removed by heating to 260° F. The crude product was then centrifuged to yield a total solid from the preparation of only 0.7 ml. The material was then polish filtered using HYFLO Supercel Filter aid. The xylene was then removed by heating to 360° F. under a slow nitrogen purge. This yielded 95.1 g of a clear, viscous, green liquid containing 1.16 (wt) % copper.

EXAMPLE XIV

Lower base number products which are often called neutral sulfonates due to the small amount of overbasing can also be used. The following details the conversion of a 40 (wt) % calcium sulfonate product with a molecular weight of about 1350 and a base number of about 15 to a copper calcium sulfonate:

A suitable vessel was charged with:

100 g Amoco A-9220 calcium sulfonate
200 ml xylene
200 ml methanol

The above was mixed well and 10 g of copper acetate monohydrate was added with mixing. Heating was begun and the mixture was refluxed for 30 min. at 151° F. The methanol was then removed by heating to 260° F. The crude product was diluted with 300 ml of xylene and clarified by centrifugation for 15 min. at 1500 rpm. The green, viscous liquid had the following analysis:

| | (wt) % |
|---|---|
| Sulfonate | 40.0 |
| Calcium | 1.3 |
| Sulfur | 1.5 |
| Copper | 1.3 |

Total base number was 23.

EXAMPLE XV

Amoco A-9221, a calcium sulfonate with a sulfonate content of about 40% with a molecular weight of about 1750 and a base number of about 15 was converted in a similar technique as shown in Example XIII. The clear, green viscous liquid had the following analysis:

| | (wt) % |
|---|---|
| % Sulfonate | 39.2 |
| % Calcium | 1.2 |
| % Sulfur | 1.3 |
| % Copper | 1.1 |

Total base number was 24.

EXAMPLE XVI

In the procedure of Example XV, Amoco A-9221, the lower base number calcium sulfonate was converted to a copper calcium sulfonate using methyl Cellosolve as the alcohol instead of methanol. This product has been assigned the number 8457-151.

EXAMPLE XVII

Amoco A-9230 is a calcium phenate or sometimes called an overbased calcium alkylphenol sulfide with total base number of about 120. This product is converted to a copper calcium phenate as follows:

A suitable vessel was charged with:
100 g A-9230
50 g 100 neutral oil
200 ml xylene
200 ml methyl Cellosolve The above was mixed well and 10.0 g of copper acetate monohydrate was added. Heating was begun and the mixture was refluxed for 30 minutes at 242° F. The methyl Cellosolve was removed by heating the mixture to 280° F. The crude product was diluted with 300 ml of xylene and clarified via centrifugation. The solvent was then removed by heating to 360° F. with a slow nitrogen gas purge. The resulting 147.4 g of dark green, viscous liquid of 81 TBN had the following properties:

| | |
|---|---|
| Copper, (wt) % | 2.05 |
| Calcium, (wt) % | 2.9 |
| Viscosity, cs at 100° C. | 144 |

This product was assigned the sample number 8457-146.

EXAMPLE XVIII

Another common calcium phenate or overbasd calcium alkyl phenol sulfide will contain higher levels of calcium which will result in higher base numbers. A product that is typical of this group is Amoco A-9231. This is also a calcium phenate or calcium alkyl phenol sulfide that has been overbased with calcium carbonate. Conversion of this type product can be typified in the following preparation:

A suitable vessel was charged with:
100 g A-9231
200 g xylene
100 ml methanol

Mixing was begun and 3.8 g of copper acetate monohydrate was added. The mixture was then heated to reflux for 30 min. at 150° F. Methanol was removed by heating to 260° F. The crude product was clarified by diluting to a total volume of 500 ml with xylene and centrifuging for 15 min. at 1500 rpm. A total of 0.2 ml of sediment was removed. The solvent was then removed from the product by heating to 360° F. with a slow $N_2$ purge. The resulting dark green viscous liquid contained 1.13 (wt) % copper.

EXAMPLE XIX

The overbased products can also be converted to copper containing materials with copper salts. The following demonstrates this type of preparation:

A suitable vessel was charged with:
100 g High base magnesium sulfonate (same as in Example XI)
200 g xylene
100 ml methanol The above was mixed well and 2.6 g of cupric chloride (anhydrous) was added. The mixture was then heated to reflux for 30 minutes at 150° F. The methanol was removed by heating to 260° F. with a slow $N_2$ purge. Clarification was accomplished by centrifugation followed by polish filtration. The resulting clear greenish, viscous liquid had a copper content of 0.7 (wt) %.

EXAMPLE XX

A similar preparation demonstrated the use of copper sulfate as the copper compound to be reacted with the overbased product. This product was designated as sample number 10281-183 and the viscous, green liquid contained 0.3 (wt) % copper.

EXAMPLE XXI

The following is an example of acid extraction of copper bearing magnesium sulfonate to demonstrate that the copper contained in the Cu-Mg sulfonate exists in an oil insoluble state and little, if any, is present as oil-soluble copper sulfonate.

Copper containing magnesium sulfonate, 20.0 g, were mixed with 80.0 g of 40/60 acetic acid/toluene solution. The deep green solution was stirred for 10 min. to completely dissolve the Cu-Mg sulfonate. All of the Cu-Mg sulfonate solution was transferred into a separatory funnel and diluted with 200 ml of hexane.

Saturated solution of sodium chloride, 150 ml, was added and mixed. A cloudy blue aqueous layer and a clear brown organic phase resulted. The aqueous layer was removed. The organic layer was washed with four 100 ml portions of saturated NaCl solution. The organic phase was isolated. The solvent was removed from the organic phase by heating to a constant weight. The organic phase was isolated. The solvent was removed from the organic phase by heating to a constant weight. The organic phase was analyzed. The residue contained only 127 parts per million (ppm) of copper. The expected copper content of the organic phase, if all of the copper were oil-soluble, would be approximately 9800 ppm.

EXAMPLE XXII

An oil thickening test (OTT) was performed on a lubricating oil composition containing a Mannich base dispersant, a zinc dialkyldithiophosphate, a low base calcium sulfonate, a high base magnesium sulfonate, and a viscosity index improver.

The oil thickening test is run by placing 95 g of a test oil and 5 g of used oil from an ASTM Sequence V-D engine test in a test tube. The test tube mixture is then sparged with air and held at 340° F. for the duration of the test. Small samples of the test oil, taken during the test, are evaluated for viscosity increase relative to the original test oil. Results are reported as a percent viscosity increase. The lower the percent viscosity increase, the better is the OTT performance.

The V-D engine test uses a 2.3 liter Ford OHC four-cylinder engine at low to mid-range and oil temperatures. Test duration is 192 hours and is run on unleaded gasoline. The test method simulates stop-and-go urban and moderate freeway driving.

TABLE I

| OTT Test of Copper Compositions | | | |
|---|---|---|---|
| Mannich base dispersant | 3.50 | 3.50 | 3.50 |
| Zinc dialkyldithiophosphate | 1.00 | 1.00 | 1.00 |
| Calcium sulfonate | 0.90 | 0.90 | 0.90 |
| Magnesium sulfonate | 1.10 | 0.55 | — |
| Copper Overbased Metallic Products: | | | |

TABLE I-continued

| OTT Test of Copper Compositions | | | |
|---|---|---|---|
| Ex. VIII - 9430-61 | — | 1.10 | — |
| Ex. VI - 9430-80 | — | — | 1.10 |
| Ex. V - 9430-84 | — | — | — |
| Ex. IX - 9430-151 | — | — | — |
| Ex. X - 8457-123 | — | — | — |
| Viscosity index improver | 7.00 | 7.00 | 7.00 |
| 330 Neutral Oil | 40.00 | 40.00 | 40.00 |
| 100 Neutral Oil | 46.50 | 45.95 | 46.50 |
| ppm Copper | — | 163 | 114 |
| OTT | | | |
| % Viscosity Increase | | | |
| 40 hours | −1 | −7 | 2 |
| 64 hours | 127 | 18 | 50 |
| 72 hours | 338 | 50 | 148 |
| 80 | TVTM* | 92 | 1182 |
| Mannich base dispersant | 3.50 | 3.50 | 3.50 |
| Zinc dialkyldithiophosphate | 1.00 | 1.00 | 1.00 |
| Calcium Sulfonate | 0.90 | 0.90 | 0.90 |
| Magnesium Sulfonate | — | — | 0.60 |
| Copper Overbased Metallic Products: | | | |
| Ex. VIII - 9430-61 | — | — | — |
| Ex. VI - 9430-80 | — | — | — |
| Ex. V - 9430-84 | 1.10 | — | — |
| Ex. IX - 9430-151 | — | 1.10 | — |
| Ex. X - 8457-123 | — | — | 0.72 |
| Viscosity Index Improver | 7.00 | 7.00 | 7.00 |
| 330 Neutral Oil | 40.00 | 40.00 | 40.00 |
| 100 Neutral Oil | 46.50 | 46.50 | 46.28 |
| ppm Copper | 114 | 108 | 150 |
| OTT | | | |
| % Viscosity Increase | | | |
| 40 hours | −5 | −10 | 65 |
| 64 hours | 64 | 43 | 28 |
| 72 hours | 123 | 148 | 75 |
| 80 hours | 728 | 1476 | 441 |

*TVTM — Too viscous to measure

The OTT test is known to correlate with IIID engine test results. The IIID engine test uses a 1977, 350 CID (5.7 liter) Oldsmobile V-8 engine at high speed (3000 rpm) and high oil temperature 300° F. (149° C.) for 64 hours with oil additions permitted. The test is run with leaded gasoline. The oil characteristics measured are: (a) high temperature oil oxidation, (b) sludge and varnish deposits, (c) engine wear. After the operating schedule is complete, the engine is disassembled and various parts are rated for cleanliness using a standard rating scale of 1–10 in which 10 is clean.

The above data indicate that copper magnesium sulfonate reduces viscosity increase under oxidative conditions despite the presence of a viscosity index improver. Sample 9430-61 at 80 hours had the lowest viscosity increase. Sample 9430-61 had a 198 TBN and 1.48 (wt) % copper.

EXAMPLE XXIII

The wear properties of a lubricant are measured by the Four Ball Wear Test. In this test, four ½" diameter SAE 52100 steel balls are arranged in a tetrahedral formation and the top ball is made to rotate against the three bottom balls, the points of contact being lubricated by the test lubricant. The top ball is rotated at 600 rpm, loaded against the three bottom balls for five successive intervals at 10, 20, 30, 40, 50 and 60 kilogram loads. During the test, the lubricating oil and steel balls are maintained at a temperature of 250° F. (121.1° C.). At the end of the test the steel balls are examined for wear, evidenced by circular scars at the indicated points of contact. The diameter of these scars is measured and reported as an average.

Formulated lubricating oil compositions were prepared containing a zinc dialkyldithiophosphate and a magnesium hydrocarbyl sulfonate. Each of the formulations were identical except for the addition of a magnesium hydrocarbyl sulfonate. As indicated by the results of the Four Ball Wear test in Table II, oil formulations containing the magnesium hydrocarbyl sulfonate gave inferior wear protection as compared with the formulation containing the zinc dialkyldithiophosphate without the addition of magnesium hydrocarbyl sulfonate.

TABLE II

| Four Ball Wear Test<br>Zinc Antiwear Additive and Magnesium Antirust Additive | Base Formula* | Test Formulas* | |
|---|---|---|---|
| | A | B | C |
| Zinc Dialkyldithiophosphate (wt) % | 0.60 | 0.60 | 0.60 |
| Magnesium Hydrocarbyl Sulfonate (wt) % | — | 1.10 | 2.20 |
| ppm Mg | — | 1045 | 2090 |
| Four Ball Wear Test Results | | | |
| Run No. 1 | 0.68 | 0.73 | 0.78 |
| Run No. 2 | — | 0.71 | 0.82 |

*Other components were identical.

The above data indicate that as the concentration of magnesium hydrocarbyl sulfonate increases in the formulation, the antiwear properties of the zinc dialkyldithiophosphate component are subject to greater interference and wear is increased due to the presence of the magnesium hydrocarbyl sulfonate.

EXAMPLE XXIV

The procedure of Example XXIII was repeated with the addition of a copper compound in the form of a copper carboxylate to the lubricating oil composition. Each of the formulations were identical except that Formulations D and E contained a copper carboxylate additive compound. The results of the Four Ball Wear Test are in Table III.

TABLE III

| Four Ball Wear Test<br>Zinc Antiwear Additive, Magnesium Antirust Additive and Copper Carboxylate | Base Formula* | Test Formulas* | | | |
|---|---|---|---|---|---|
| | A | B | C | D | E |
| Zinc Dialkyldithiophosphate (wt) % | 0.60 | 0.60 | 0.60 | 0.60 | 0.60 |
| Magnesium Hydrocarbyl Sulfonate (wt) % | — | 1.10 | 2.20 | 1.10 | 2.20 |
| Copper Carboxylate (wt) % | — | — | — | 0.08 | 0.17 |
| ppm Mg | — | 1045 | 2090 | 1045 | 2090 |
| ppm Cu | — | — | — | 96 | 204 |
| Four Ball Test Results | | | | | |
| Run No. 1 | 0.68 | 0.73 | 0.78 | 0.81 | 0.98 |
| Run No. 2 | — | 0.71 | 0.82 | — | 0.98 |

*Other components were identical.

The above data indicate that as the concentration of magnesium hydrocarbyl sulfonate increases, the presence of copper increasingly interferes with the antiwear properties of zinc dialkyldithiophosphate. The presence of approximately 100 ppm of copper in Formula D increases the amount of wear approximately 10% over an equivalent Formula B containing a magnesium hydrocarbyl sulfonate but without the presence of the copper compound. Similarly, the presence of approximately 200 ppm of copper in Formula E increases the amount of wear over 25% over Formula C.

The above data indicate that the presence of copper, even in small amounts, interferes with the antiwear properties of zinc dialkyldithophosphate.

EXAMPLE XXV

The procedure of Example XXIV was repeated; however, copper magnesium hydrocarboyl sulfonate of this invention was substituted for the magnesium hydrocarboyl sulfonate and copper carboxylate compounds. Each of the formulations was identical except for the above substitutions. Results are in Table IV.

TABLE IV

Four Ball Wear Test
Copper Magnesium Hydrocarbyl Sulfonate

| | Test Formulas* | | | | | |
|---|---|---|---|---|---|---|
| | D | E | F | G | H | I |
| Zinc Dialkyl-dithiophosphate (wt) % | 0.60 | 0.60 | 0.60 | 0.60 | 0.60 | 0.60 |
| Magnesium Hydrocarbyl Sulfonate (wt) % | 1.10 | 2.20 | — | — | — | — |
| Copper Carboxylate (wt) % | 0.08 | 0.17 | — | — | — | — |
| Copper Magnesium Hydrocarbyl Sulfonate (wt) % | | | | | | |
| Ex. IX | — | — | 1.10 | 2.20 | — | — |
| Ex. XII | — | — | — | — | 1.10 | 2.20 |
| ppm Mg | 1045 | 2090 | 1045 | 2090 | 1045 | 2090 |
| ppm Cu | 96 | 204 | 110 | 220 | 132 | 264 |
| Four Ball Test Results | | | | | | |
| Run No. 1 | 0.81 | 0.98 | 0.75 | 0.86 | 0.71 | 0.82 |
| Run No. 2 | — | 0.98 | — | 0.81 | — | — |

*Other components were identical.

The above data indicate that copper magnesium hydrocarbyl sulfonate of this invention effectively decreases the amount of wear occasioned by the presence of both a magnesium hydrocarbyl sulfonate rust inhibitor and a copper carboxylate when the copper magnesium hydrocarbyl sulfonate is used instead of the combined use of the above two compounds in a lubricating oil composition.

EXAMPLE XXVI

Tests were conducted which demonstrated the substantial synergistic effect of the present invention. The test used was the industry recognized ASTM Sequence IIID test which has been described.

The base test oil was a fully formulated mineral oil which contained a conventional sulfurized antioxidant. The test oil contained the same base oil and concentrations of components, dispersant, zinc dialkyldithiophosphate, calcium sulfonate, viscosity index improver, and pour point depressant, except that the high-base magnesium sulfonate and sulfurized antioxidant were replaced with a Cu-Mg sulfonate as shown below:

| Formulation Components | Base Formula* | Test Formula* |
|---|---|---|
| Sulfurized Antioxidant | 1.00 (wt) % | — |
| Magnesium Sulfonate | 1.10 | — |
| Cu—Mg Sulfonate - Ex. XII | — | 1.10 |
| ppm Copper in oil | 0 | 130 |

*Other components were identical.

Results of the IIID tests show that the product of the current invention gives far better engine test performance than the conventional additive as indicated by the lower viscosity increase and higher cleanliness ratings:

| IIID Results | Base Formula* | Test Formula* |
|---|---|---|
| % Viscosity Increase | | |
| 40 hrs | 254 | 20 |
| 64 hrs | TVTM** | 52 |
| Sludge | 7.37 | 9.75 |
| Piston Varnish | 7.44 | 9.47 |
| Ring Land Face Varnish | 2.66 | 7.27 |
| Wear, max. | 0.0029 | 0.0024 |
| avg. | 0.0019 | 0.0019 |

*Other components were identical.
**Too viscous to measure.

It should be noted that supplemental antioxidants can be added to the above base formula and to the above test formula in an amount of from about 0.1 to about 2.0 (wt) %, preferably from about 0.2 to about 1.0 (wt) %. Supplemental friction modifiers can be added to the above base formula also in an amount of from about 0.1 to about 2.0 (wt) %, perferably from about 0.2 to about 1.0 (wt) %. Further improvement in various test results can be expected with inclusion of supplemental antioxidants and/or supplemental friction modifiers.

EXAMPLE XXVII

Tests were conducted which demonstrated the antirust properties of the present invented composition in a lubricating oil formulation. The test used was the industry recognized General Motors IID rust test. The IID engine test uses a 1977, 350 CID (5.7 liter) Oldsmobile V-8 engine at moderate speed (1500 rpm) for 30 hours and oil temperature of 120° F. (48.9° C.) followed by a shut-down for 30 minutes and two hours at high speed (3600 rpm) and high oil temperature 260° F. (127° C.). Oil additions are permitted. The test is run with leaded gasoline. After the operating schedule is complete, the engine is disassembled and the valve train is rated for rust or corrosion by trained operators against a standard rating scale of from 1–10 in which 10 is no rust or corrosion. A rating of 8.5 or higher is passing.

The control experiment was run on an oil-containing copper carboxylate and a commercial rust inhibitor comprising an overbased magnesium hydrocarbyl sulfonate of 400 TBN. The test oil formulation was identical except for the substitution of the copper magnesium hydrocarbyl sulfonate in the test formulation for the copper carboxylate and the commercial rust inhibitor in the control formulation. The commercial rust inhibitor is available from Amoco Petroleum Additives Company, Clayton, Mo. Both control and test formulations contained identical amounts of borated Mannich dispersant, zinc dithiophosphate, low base calcium sulfonate and non-dispersant viscosity index improver. The engine test results are in Table V.

TABLE V

IID Engine Test Results

| Oil Formulation | Control A | Test B |
|---|---|---|
| Commercial Rust Inhibitor (wt) % | 1.10 | — |
| Copper Carboxylate | 0.08 | — |
| Copper Magnesium Hydrocarbyl Sulfonate - Ex. XII | — | 1.10 |
| Remainder of Formulation | Balance | Balance |
| IID Engine Test Results | 8.55 | 8.58 |

The above IID engine test results indicate the copper magnesium hydrocarbyl sulfonate passes the IID engine test and is equivalent to a rust inhibitor commercially available for use in motor oil lubricating oil blends.

It should be noted that the non-dispersant viscosity index improver can be replaced in toto in the above base formula by a polymeric viscosity index improver dispersant comprising a polymer of ethylene and a $C_3$–$C_{20}$ olefin further reacted with oxygen and subsequently with formaldehyde and an amine.

What is claimed is:

1. A lubricating oil composition comprising: (a) a major amount of a lubricating oil; (b) from 0 to 10 (wt) % of an ashless dispersant compound; (c) from 0 to 10 (wt) % of at least one viscosity index improver selected from the group consisting of a nitrogen-containing polymeric viscosity index improver dispersant, an ester-containing polymeric viscosity index improver dispersant, and a non-dispersant viscosity index improver; and (d) from 0.01 to 10.0 parts by weight per 100 parts of said lubricating oil composition of zinc dialkyldithiophosphate and characterized in that the lubricant oil composition further contains from 0.1 to 5.0 (wt) % of a dispersant/detergent, antioxidant, and corrosion inhibitor comprising at least one overbased copper metal-containing compound selected from the group consisting of an overbased copper magnesium sulfonate, an overbased copper calcium sulfonate, an overbased copper sodium sulfonate, and an overbased copper calcium phenate.

2. The composition of claim 1 wherein said ashless dispersant is (A) a nitrogen or ester containing dispersant compound selected from the group consisting of: (i) oil soluble salts, amides, imides, oxazolines and esters, or mixtures thereof, of long chain hydrocarbon substituted mono- and di-carboxylic acids or their anhydrides; (ii) long chain aliphatic hydrocarbon having a polyamine attached directly thereto; and (iii) Mannich condensation products formed by condensing about a molar proportion of long chain hydrocarbon-substituted phenol with about 1 to 2.5 moles of formaldehyde and about 0.5 to 2 moles of polyalkylene polyamine; wherein said long chain hydrocarbon group is a polymer of a $C_2$ to $C_5$ monoolefin, said polymer having a molecular weight of about 700 to about 5000; or (B) a nitrogen or ester-containing polymeric viscosity index improver dispersant which includes: (1) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons; (2) polymers of $C_2$ to $C_{20}$ olefin with unsaturated $C_3$ to $C_{10}$ mono- or di-carboxylic acid neutralized with amine, hydroxy amine, or alcohols; and (3) polymers of ethylene with a $C_3$ to $C_{20}$ olefin further reacted either by grafting $C_4$ to $C_{20}$ unsaturated nitrogen-containing monomers thereon, or by grafting an unsaturated acid onto the polymer backbone and then reacting said carboxylic acid groups with amine, hydroxy amine, or alcohol; or (C) mixtures of (A) and (B).

3. The composition of claim 1 wherein said ashless dispersant is selected from the group consisting of an alkenyl succinic acid, an anhydride of an ester of alkenyl succinic acid, an anhydride derived from monohydric or polyhydric alcohols, phenols, or naphthols, the reaction product of polyisobutenyl succinic anhydride with an amine selected from the group consisting of ethoxylated polyalkylpolyamines, propoxylated polyalkylpolyamines and polyalkenylpolyamines and the borated reaction product of polyisobutenyl succinic anhydride with an amine selected from the group consisting of ethoxylated polyalkylpolyamines, propoxylated polyalkylpolyamines and polyalkenylpolyamines.

4. The composition of claim 1 wherein said composition contains an ash-containing detergent selected from the group consisting of an overbased alkyl phenate or overbased sulfurized alkyl phenate selected from the group of magnesium phenates, calcium phenates, and sodium phenates or mixtures thereof, an overbased salicylate selected from the group of magnesium salicylate, calcium salicylate, and sodium salicylate or mixtures thereof, and an overbased sulfonate selected from the group of magnesium sulfonates, calcium sulfonates, and sodium sulfonates or mixtures thereof.

5. The composition of claim 1 wherein said zinc dialkyldithiophosphate is selected from the group consisting of compounds prepared from secondary alcohols, primary alcohols, phenols, alkylphenols, mixtures of alkylphenols, and mixtures of secondary alcohols, primary alcohols, phenols, and alkylphenols.

6. The composition of claim 1 wherein said composition contains supplemental antioxidants selected from the group consisting of hindered phenols, aryl amines, sulfurized unsaturated esters, sulfurized carboxylate salts, and oil-soluble metal compounds selected from the group of oil-soluble salts of carboxylic acids of from 3 to 20 carbon atoms wherein said metal is copper, molybdenum, cobalt, or nickel.

7. The lubricating oil composition of claim 1 wherein said ashless dispersant is (A) a nitrogen- or ester-containing dispersant compound selected from the group consisting of: (i) oil soluble salts, amides, imides, oxazolines and esters, or mixtures thereof, of long chain hydrocarbon substituted mono-and di-carboxylic acids or their anhydrides; (ii) long chain aliphatic hydrocarbon having a polyamine attached directly thereto; and (iii) Mannich condensation products formed by condensing about a molar proportion of long chain hydrocarbon-substituted phenol with about 1 to 10 moles of formaldehyde and about 0.5 to 2 moles of polyalkylene polyamine wherein said long chain hydrocarbon group is a polymer of a $C_2$ to $C_5$ monoolefin, said polymer having a molecular weight of about 700 to about 5000; or (B) a nitrogen- or ester-containing polymeric viscosity index improver dispersant which includes: (1) polymers compirsed of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons; (2) polymers of $C_2$ to $C_{20}$ olefin with unsaturated $C_3$ to $C_{10}$ mono- or di-carboxylic acid neutralized with amine, hydroxy amine, or alcohols; (3) polymers of ethylene with a $C_3$ to $C_{20}$ olefin further reacted either by grafting $C_4$ to $C_{20}$ unsaturated nitrogen-containing monomers thereon, or by grafting an unsaturated acid onto the polymer backbone and then reacting said carboxylic acid groups with amine, hydroxy amine, or alcohol; and (4) polymers of ethylene and a $C_3$ to $C_{20}$ olefin further reacted first with oxygen and subsequently with formaldehyde and an amine; or (C) mixtures of (A) and (B); wherein said Mannich condensation product of (iii) comprises the product of reactants in the mole ratio of about 1 mole of polyisobutenylphenol with from about 1 to about 10 moles of formaldehyde, from about 0.5 to about 2 moles of polyethylenepolyamine and from about 0.1 to about 1.0 moles of a $C_6$ to $C_{100}$ alkanoic or sulfonic acid, wherein said Mannich condensation product is be borated with from about 0.1 to about 5.0 moles boron per mole of polyisobutenylphenol; wherein said ashless dispersant compound comprises the reaction product of polyisobutenyl succinic anhydride with an amine selected from the group consisting of ethoxylated polyalkylpolyamines, polyalkylpolyamines, and polyethylene polyamines; wherein said ashless dispersant reaction product of polyisobutenyl succinic anhydride with an amine is borated with from about 0.1 to about 5 moles of boron per mole of reaction product; wherein said non-dispersant polymeric viscosity index improver is selected from the group consisting of olefin copolymers, acrylate polymers, hydrogenated copolymers and hydrognated stryrene copolymers; wherein said zinc dialkyldithiophosphate is selected from the group consisting of compounds prepared from secondary alcohols, primary alcohols, phenols, alkylphenols, mixtures of alkylphenols, and mixturs of secondary alcohols, primary alcohols, phenols, and alkylphenols; wherein said composition contains an overbased alkyl phenate or overbased sulfurized alkyl phenate selected from the group of magnesium phenates, calcium phenates, sodium phenates and mixtures thereof; wherein said composition contains an overbased salicylate selected from the group of magnesium salicylate, calcium salicylate, sodium salicylate and mixtures thereof; wherein said composition contains an overbased sulfonate selected from the group consisting of magnesium sulfonates, calcium sulfonates, sodium sulfonates and mixtures thereof; wherein said composition contains a supplemental friction modifier selected from the group consisting of glycerol monooleate, pentaerythritol monooleate, oleamide, amides derived from polyamines and alkanol amines, triazoles derived from aminoguanidine and carboxylic acids, molybdenum thiophosphonates, molybdenum carboxylates, molybdenum dithiophosphates, molybdenum amine complexes, molybdenum disulfide and mixtures thereof; and wherein said composition contains a supplemental antioxidant selected from the group consisting of hindered phenols, aryl amines, sulfurized olefins, sulfurized carboxylate unsaturated esters containing olefin groups; sulfurized carboxylate salts, and oil-soluble metal compounds selected from the group of oil-soluble salts of carboxylic acids of from 3 to 20 carbon atoms wherein said metal is copper, molybdenum, cobalt, or nickel, and mixtures thereof.

8. The composition of claim 1 wherein said viscosity index improver is a nitrogen- or ester-containing polymeric viscosity index improver dispersant.

9. A concentrate of a lubricating oil composition wherein said concentrate comprises (a) from 0 to 65 (wt) % of an ashless dispersant; (b) from 0 to 20 (wt) % of at least one viscosity index improver selected from the group consisting of a nitrogen-containing polymeric viscosity index improver dispersant, an ester-containing polymeric viscosity index improver dispersant, and a non-dispersant polymeric viscosity index improver; and (c) from to 2 to 25 parts by weight of a zinc dialkyldithiophosphate and from 5 to 25 (wt) % of a dispersant/detergent, antioxidant, and corrosion inhibitor comprising an overbased copper metal-containing compound selected from the group consisting of an overbased copper magnesium sulfonate, an overbased copper calcium sulfonate, an overbased copper sodium sulfonate and an overbased copper calcium phenate.

10. The concentrate of claim 9 wherein said ashless dispersant is (A) a nitrogen- or ester-containing dispersant compound selected from the group consisting of: (i) oil-soluble salts, amides, and esters, or mixtures thereof, of long chain hydrocarbon-substituted mono- and di-carboxylic acids or their anhydrides; (ii) long chain aliphatic hydrocarbon having a polyamine attached directly thereto; and (iii) Mannich condensation products formed by condensing about a molar proportion of long chain hydrocarbon-substituted phenol with about 1 to 2.5 moles of formaldehyde and about 0.5 to 2 moles of polyalkylene polyamine; wherein said long chain hydrocarbon group is a polymer of a $C_2$ to $C_5$ monoolefin, said polymer having a molecular weight of about 700 to about 5000; or (B) from 0.3 to 10 (wt) % of a nitrogen- or ester-containing polymeric viscosity index improver dispersant which includes: (1) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons; (2) polymers of $C_2$ to $C_{20}$ olefin with unsaturated $C_3$ to $C_{10}$ mono- or di-carboxylic acid neutralized with amine, hydroxy amine, or alcohols; (3) polymers of ethylene with a $C_3$ to $C_{20}$ olefin further reacted either by grafting $C_4$ to $C_{20}$ unsaturated nitrogen-containing monomers thereon or by grafting an unsaturated acid onto the polymer backbone and then reacting said carboxylic acid groups with amine, hydroxy amine or alcohol; or (C) mixtures of (A) and (B).

11. The concentrate of claim 9 wherein said ashless dispersant is selected from the group consisting of an alkyl succinic acid, an anhydride or an ester of alkenyl succinic acid, an anhydride derived from monohydric or polyhydric alcohols, phenols or naphthols, the reaction product of polyisobutenyl succinic anhydride with an amine selected from the group consisting of ethoxylated polyalkylpolyamines, propoxylated polyalkylpolyamines, and polyalkenylpolyamines, and the borated reaction product of polyisobutenyl succinic anhydride with an amine selected from the group consisting of ethoxylated polyalkylpolyamines, propoxylated polyalkylpolyamines, and polyalkenylpolyamines.

12. The concentrate of claim 9 wherein said concentrate contains an ash-containing detergent selected from the group consisting of an overbased phenate or overbased alkylphenol sulfide selected from the group consisting of magnesium phenates, calcium phenates, and sodium phenates or mixtures thereof, an overbased salicylate selected from the group consisting of magnesium salicylates, calcium salicylates, and sodium salicylates, and an overbased sulfonate selected from the group consisting of magnesium sulfonates, calcium sulfonates, and sodium sulfonates.

13. The concentrate of claim 9 wherein said zinc dialkyldithiophosphate is selected from the group consisting of compounds prepared from secondary alcohols, primary alcohols, phenols, alkylphenols, mixtures of alkylphenols, and mixtures of secondary alcohols, primary alcohols, phenols, and alkylphenols.

14. The concentrate of claim 9 wherein said concentrate contains supplemental antioxidants selected from the group consisting of hindered phenols, aryl amines, sulfurized unsaturated esters, sulfurized carboxylate salts, and oil-soluble metal compounds selected from the group of oil-soluble salts of carboxylic acids of from 3 to 20 carbon atoms wherein said metal is copper, molybdenum, cobalt or, nickel.

15. The concentrate of claim 9 wherein said ashless dispersant is (A) a nitrogen- or ester-containing dispersant compound selected from the group consisting of: (i) oil-soluble salts, amides, and esters, or mixtures thereof, of long chain hydrocarbon-substtituted mono- and di-carboyxlyic acids or their anhydrides; (ii) long chain aliphatic hudrocarbon having a polyamine attached directly thereto; and (iii) Mannich condensation products formed by condensing about a molar proportion of long chain hydrocarbon-substituted phenol with about 1 to 10 moles of formaldehyde and about 0.5 to 2 moles of polyalkylene polyamine; wherein said long chain hydrocarbon group is a polymer of a $C_2$ to $C_5$ monooliefin, said polymer having a molecular weight of about 700 to about 5000; or (B) a nitrogen- or ester-containing polymeric viscosity index improver dispersant which includes: (1) polymers comprised of $C_4$ to $C_{24}$ unsaturated esters of vinyl alcohol or $C_3$ to $C_{10}$ unsaturated mono- or di-carboxylic acid with unsaturated nitrogen-containing monomers having 4 to 20 carbons; (2) polymers of $C_2$ to $C_{20}$ olefin with unsaturated $C_3$ to $C_{10}$ mono- di-carboxylic acid neutralized with amine, hydroxy amine, or alcohols; (3) polymers of ethylene with a $C_3$ to $C_{20}$ olefin further reacted either by grafting $C_4$ to $C_{20}$ unsaturated nitrogen-containing monomers thereon or by grafting an unsaturated acid onto the polymer backbone and then reacting said caroxylic acid groups with amine, hydroxy amine or alcohol; and (4) polymers of ethylene and a $C_3$ to $C_{20}$ olefin further reacted first with oxygen and subsequently with formaldehyde and an amine; or (C) mixtures of (A) and (B); wherein said Mannich condensation product of (iii) comprises the product of reactants in the mole ratio of about 1 mole of polyisobutenylphenol with about 1 to about 10 moles of formaldehyde, from about 0.5 to about 2 moles of polyethylenepolyamine and from about 0.1 to about 1.0 moles of a $C_6$ to $C_{100}$ alkanoic or sulfonic acid; wherein said Mannich condensation product is borated with from about 0.1 to about 5.0 moles boron boron per mole of polyisobutenylphenol; wherein said ashless dispersant compound comprises the reaction product of polyisobutenyl succinic anhydride with an amine selected from the group consisting of ethoxylated polyalkylpolyamines, propoxylated polyalkylpolyamines and plyethylenepolyamines; wherein said reaction product of polyisobutenyl succinic anhydride with an amine is borated with from about 0.1 to about 5 moles of boron per mole of reaction product; wherein said non-dispersant viscosity index improver is selected from the group consisting of olefin coplymers, acrylate polymers, hydrogenated copolymers, and hydrogenated stryrene copolymers; wherein said zinc dialkyldithiophosphate is selected from the group consisting of compounds prepared from secondary alcohols, primary alcohols, phenols, alkylphenols, mixtures of alkylphenols, and mixtures of secondary alcohols, primary alcohols, phenols, and alkylphenols; wherein said composition contains an overbased alkyl phenate or an overbased sulfurized alkyl phenate selected from the group consisting of magnesium phenates, calcium phenates, sodium phenates and mixtures thereof; wherein said concentrate contains an overbased salicylate selected from the group consisting of magnesium salicylates, calcium salicylates, and sodium salicylates; wherein said concentrate contains an overbased sulfonate selected from the group consisting of magnesium sulfonates, calcium sulfonates, and sodium sulfonates; wherein said concentrate contains a supplemental friction modifier selected from the group consisting of gylcerol monooleate, pentaerythritol monooleate, oleamide, amides derived from polyamines and alkanol amines, triazoles derived from aminoguanidine and carboxylic acids, molybdenum thiophosphonates, moleybdenum carboxylates, molybdenum dithiophosphates, molybdenum amine complexes, molybdenum disulfide and mixtures thereof, and wherein said concentrate contains a supplemental antioxidant selected from the group consisting of hindered phenols, aryl amines, sulfurized olefins, sulfurized carboxylate unsaturated esters containing olefin groups, sulfurized carboxylate salts, and oil-soluble metal compounds selected from the group of oil-soluble salts of carboxylic acids of from three to 20 carbon atoms wherein said metal is copper, molybdenum, cobalt, or nickel and mixtures thereof.

16. The concentrate of claim 9 wherein said viscosity index improver is a nitrogen- or ester-containing polymeric viscosity index improver dispersant.

* * * * *

UNITED STATES PATENT OFFICE
CERTIFICATE OF CORRECTION

Patent No. 4,767,551 Dated August 30, 1988

Inventor(s) Mack W. Hunt and Steven Kennedy

It is certified that error appears in the above-identified patent and that said Letters Patent are hereby corrected as shown below:

Patent reads:

| Col. | Line | |
|---|---|---|
| 4 | 4 | "improver," and should read --improver;-- |
| 5 | 31 | "oelow" and should read --below-- |
| 9 | 6 | "1-hexene:" and should read --1-hexene;-- |
| 10 | 39 | "propylsubstituted" and should read --propyl-substituted-- |
| 12 | 18 | "naphtha mineral oil" and should read --naphtha, mineral oil-- |
| 13 | 1 | "nondispersant" and should read --non-dispersant-- |
| 13 | 60 | "etnylene" and should read --ethylene-- |
| 14 | 8 | "tnereof" and should read --thereof-- |
| 14 | 9 | "Otner" and should read --other-- |
| 14 | 37 | "pyrrolodone" and should read --pyrrolidone-- |
| 14 | 50 | "dicyclopentadien" and should read --dicyclopentadiene-- |
| 14 | 52 | "5-methylene--2-norbornene," and should read --5-methylene-2-norbornene-- |
| 15 | 2 | "nondispersant" and should read --non-dispersant-- |
| 16 | 7 | "about 10 wt.% percent," and should read --about 10 wt.%,-- |

UNITED STATES PATENT OFFICE
CERTIFICATE OF CORRECTION

Patent No. 4,767,551 Dated August 30, 1988

Inventor(s) Mack W. Hunt and Steven Kennedy

It is certified that error appears in the above-identified patent and that said Letters Patent are hereby corrected as shown below:

Patent reads:

| Col. | Line | |
|---|---|---|
| 17 | 48 | "concenterate" and should read --concentrate-- |
| 22 | 12 | "nitrogencontaining" and should read --nitrogen-containing-- |
| 23 | 61 | "very" and should read --every-- |
| 27 | 33 | "overbasd" and should read --overbased-- |
| 28 | 30-34 | "...was isolated. The solvent was removed from the organic phase by heating to a constant weight. The organic phase was isolated. The solvent was removed from the organic phase by heating to a constant weight. The organic phase was analyzed." and should read --...was isolated. The solvent was removed from the organic phase by heating to a constant weight. The organic phase was analyzed.-- |
| 31 | 5 | "dialkyldithophosphate." and should read --dialkyldithiophosphate-- |
| 31 | 9 | "hydrocarboyl" and should read --hydrocarbyl-- |
| 31 | 10-11 | "hydrocarboyl" and should read --hydrocarbyl-- |
| 35 | 1 | "is be borated" and should read --is borated-- |
| 35 | 18 | "mixturs" and should read --mixtures-- |
| 37 | 1 | "substttuted" and should read --substituted-- |

UNITED STATES PATENT OFFICE

CERTIFICATE OF CORRECTION

Patent No. 4,767,551 Dated August 30, 1988

Inventor(s) Mack W. Hunt and Steven Kennedy

It is certified that error appears in the above-identified patent and that said Letters Patent are hereby corrected as shown below:

Patent reads:

| Col. | Line | |
|---|---|---|
| 37 | 3 | "hudrocarbon" and should read --hydrocarbon-- |
| 37 | 10 | "monooliefin" and should read --monoolefin-- |
| 37 | 41 | "plyethylenepolyamines" and should read --polyethylenepolyamines-- |
| 38 | 4 | "coplymers" and should read --copolymers-- |

Signed and Sealed this

Eleventh Day of April, 1989

*Attest:*

DONALD J. QUIGG

*Attesting Officer*

*Commissioner of Patents and Trademarks*